US009905171B2

(12) United States Patent
Izumi et al.

(10) Patent No.: US 9,905,171 B2
(45) Date of Patent: Feb. 27, 2018

(54) DISPLAY, DISPLAY DRIVE CIRCUIT, DISPLAY DRIVE METHOD, AND ELECTRONIC APPARATUS

(71) Applicant: Sony Corporation, Tokyo (JP)

(72) Inventors: Gaku Izumi, Tokyo (JP); Seiichiro Jinta, Kanagawa (JP)

(73) Assignee: Sony Corporation, Tokyo (JP)

( * ) Notice: Subject to any disclaimer, the term of this patent is extended or adjusted under 35 U.S.C. 154(b) by 336 days.

(21) Appl. No.: 14/174,909

(22) Filed: Feb. 7, 2014

(65) Prior Publication Data

US 2014/0253421 A1 Sep. 11, 2014

(30) Foreign Application Priority Data

Mar. 6, 2013 (JP) ..... 2013-044439

(51) Int. Cl.
*G09G 3/36* (2006.01)
*G09G 3/3225* (2016.01)
*G09G 3/20* (2006.01)

(52) U.S. Cl.
CPC ..... *G09G 3/36* (2013.01); *G09G 3/3225* (2013.01); *G09G 3/2074* (2013.01); *G09G 2300/0852* (2013.01); *G09G 2310/06* (2013.01); *G09G 2320/0276* (2013.01); *G09G 2360/16* (2013.01)

(58) Field of Classification Search
CPC ..... G09G 3/36; G09G 3/3225; G09G 3/2074; G09G 2310/06; G09G 2360/16; G09G 2320/0276; G09G 2300/0852; G09G 3/22; G09G 3/34; G09G 2300/0465; G09G 2320/0233
USPC ..... 345/9, 44–48, 82; 313/504, 462
See application file for complete search history.

(56) References Cited

U.S. PATENT DOCUMENTS

| | | | | |
|---|---|---|---|---|
| 7,327,340 | B2 * | 2/2008 | Someya | G09G 3/2011 345/690 |
| 2005/0116907 | A1 * | 6/2005 | Miyazawa | G09G 3/3241 345/76 |
| 2005/0207249 | A1 * | 9/2005 | Morita | G09G 3/3233 365/203 |
| 2005/0243038 | A1 * | 11/2005 | Kwak | G09G 3/3208 345/76 |
| 2006/0044244 | A1 * | 3/2006 | Numao | G09G 3/3233 345/92 |

(Continued)

FOREIGN PATENT DOCUMENTS

JP 2008-083084 A 4/2008

*Primary Examiner* — Vinh Lam
(74) *Attorney, Agent, or Firm* — Michael Best & Friedrich LLP

(57) ABSTRACT

Correction processing is provided for a display having pixel circuits respectively including a display element and a drive transistor that is configured to provide a drive current to the display element according to a luminance information value. A control transistor is disposed on a current path that provides the drive current to a unit pixel group that includes two or more of the pixel circuits, and a correction processing section is configured to obtain a correction factor that is a function of the luminance information values respectively corresponding to each of the pixel circuits in the unit pixel group, and to perform a correction of the luminance information value for at least one of the pixel circuits in the unit pixel group based on the correction factor.

19 Claims, 22 Drawing Sheets

(56) References Cited

U.S. PATENT DOCUMENTS

2006/0055657 A1* 3/2006 Koyama ..... G09G 5/24 345/102
2006/0145964 A1* 7/2006 Park ..... G09G 3/3233 345/76
2006/0208974 A1* 9/2006 Hara ..... G09G 3/3233 345/76
2007/0001939 A1* 1/2007 Hashimoto ..... G09G 3/3233 345/76
2007/0229413 A1* 10/2007 Hara ..... G09G 3/3258 345/76
2008/0001855 A1* 1/2008 Hamer ..... G09G 3/3233 345/76
2008/0062096 A1* 3/2008 Yamashita ..... G09G 3/2074 345/82
2008/0111774 A1* 5/2008 Iida ..... G09G 3/3233 345/76
2009/0135304 A1* 5/2009 Inoue ..... G09G 3/3208 348/712
2009/0174628 A1* 7/2009 Wang ..... G09G 3/3225 345/76
2009/0231256 A1* 9/2009 Kim ..... G09G 3/3648 345/89
2010/0149226 A1* 6/2010 Byun ..... G09G 3/3225 345/690
2010/0321348 A1* 12/2010 Kim ..... G09G 3/20 345/204
2011/0109612 A1* 5/2011 Chaji ..... G09G 3/3283 345/211
2012/0013635 A1* 1/2012 Beeman ..... G09G 3/2003 345/590
2012/0249574 A1* 10/2012 Botzas ..... G09G 3/20 345/605
2012/0287171 A1* 11/2012 Mizukoshi ..... G09G 3/3233 345/690
2013/0083083 A1* 4/2013 Woo ..... G09G 3/3208 345/690
2013/0135272 A1* 5/2013 Park ..... G09G 3/3233 345/211
2013/0307760 A1* 11/2013 Kim ..... G09G 3/3208 345/83
2014/0077688 A1* 3/2014 Weaver ..... H01L 51/5004 313/504
2014/0092076 A1* 4/2014 Lee ..... G09G 3/3291 345/212
2015/0255012 A1* 9/2015 Gu ..... H01L 27/3209 345/83

* cited by examiner

DISPLAY, DISPLAY DRIVE CIRCUIT, DISPLAY DRIVE METHOD, AND ELECTRONIC APPARATUS

CROSS REFERENCE TO RELATED APPLICATIONS

This application claims the benefit of Japanese Priority Patent Application JP 2013-44439 filed Mar. 6, 2013, the entire contents of which are incorporated herein by reference.

BACKGROUND

The present disclosure relates to a display including a current-drive display device, a display drive circuit and a display drive method for such a display, and an electronic apparatus including such a display.

In a field of a display performing image display, there has been developed and commercialized in recent years a display (such as an organic electro luminescence display) including, as a light emitting device, a current-drive optical device that emits light of which the luminance varies depending on an applied current value, for example, an organic EL device. Unlike a liquid crystal device, etc., the light emitting device is a self-luminous light emitting device and hence provision of a light source (backlight) is not necessary. The organic EL display therefore has features of high image viewability, low power consumption, and fast response compared with a liquid crystal display which indispensably includes a light source.

Displays are in general desired to have high image quality. Image quality is determined by various factors including definition. For example, high-definition image display may be recently desired not only for a standalone television receiver but also for a mobile terminal such as a smartphone. Various techniques have been accordingly developed in order to improve resolution of a display. For example, Japanese Unexamined Patent Application Publication No. 2008-83084 discloses an organic EL display including sub-pixels in a so-called 5Tr1C configuration, in which horizontally adjacent three sub-pixels of red (R), green (G), and blue (B) share a switching transistor (power supply transistor). In this display, three sub-pixels share a power supply transistor as described above, and thus the number of devices is decreased in order to improve resolution.

SUMMARY

As described above, displays have been in general desired to have high image quality, and are now promised to be further improved in image quality.

It is desirable to provide a display, a display drive circuit, a display drive method, and an electronic apparatus capable of improving image quality.

According to an embodiment of the present disclosure, there is provided a display (1) including: a plurality of unit pixels; a control transistor; and a correction processing section. The plurality of unit pixels each includes a display device and a drive transistor that is configured to supply a drive current to the display device, the control transistor is disposed on a current path of the drive current to a unit pixel group formed of a predetermined number of unit pixels out of the plurality of unit pixels, and the correction processing section is configured to obtain a signal average of a plurality of pieces of luminance information out of a predetermined number of pieces of luminance information corresponding to the predetermined number of unit pixels, and correct the plurality of pieces of luminance information based on the signal average.

According to another embodiment of the present disclosure, there is provided a display (2) including: a plurality of unit pixels; a control transistor; and a correction processing section. The plurality of unit pixels each include a display device and a drive transistor that is configured to supply a drive current to the display device, the control transistor is disposed on a current path of the drive current to a unit pixel group formed of a predetermined number of unit pixels out of the plurality of unit pixels, and the correction processing section is configured to correct luminance information of a focused unit pixel in the unit pixel group to prevent luminance of the focused unit pixel from being varied by luminance information of a unit pixel other than the focused unit pixel in the unit pixel group.

According to another embodiment of the present disclosure, there is provided a display drive circuit including: a correction processing section; and a drive section. The correction processing section is configured to obtain a signal average of a plurality of pieces of luminance information out of a predetermined number of pieces of luminance information corresponding to a predetermined number of unit pixels of a unit pixel group, and correct the plurality of pieces of luminance information based on the signal average, the unit pixel group being formed of the predetermined number of unit pixels out of a plurality of unit pixels each including a display device and a drive transistor that is configured to supply a drive current to the display device, a control transistor being disposed on a current path of the drive current to the unit pixel group, and the drive section is configured to drive the unit pixels based on the pieces of corrected luminance information.

According to another embodiment of the present disclosure, there is provided a display drive method including: obtaining a signal average of a plurality of pieces of luminance information out of a predetermined number of pieces of luminance information corresponding to a predetermined number of unit pixels of a unit pixel group, the unit pixel group being formed of the predetermined number of unit pixels out of a plurality of unit pixels each including a display device and a drive transistor that is configured to supply a drive current to the display device, a control transistor being disposed on a current path of the drive current to the unit pixel group; correcting the plurality of pieces of luminance information based on the signal average; and driving the unit pixels based on the pieces of corrected luminance information.

According to another embodiment of the present disclosure, there is provided an electronic apparatus provided with a display and a control section configured to perform operation control on the display. The display includes: a plurality of unit pixels; a control transistor; and a correction processing section. The plurality of unit pixels each includes a display device and a drive transistor that is configured to supply a drive current to the display device, the control transistor is disposed on a current path of the drive current to a unit pixel group formed of a predetermined number of unit pixels out of the plurality of unit pixels, and the correction processing section is configured to obtain a signal average of a plurality of pieces of luminance information out of a predetermined number of pieces of luminance information corresponding to the predetermined number of unit pixels, and correct the plurality of pieces of luminance information based on the signal average. Examples of the electronic apparatus may include a television unit, a digital camera, a personal computer, a video camera, and a mobile terminal device such as a mobile phone.

In the display (1), the display drive circuit, the display drive method, and the electronic apparatus according to the above-described respective embodiments of the disclosure, each of the predetermined number of unit pixels belonging to the unit pixel group performs display based on the luminance information. At this time, a plurality of pieces of luminance information out of the predetermined number of pieces of luminance information corresponding to the predetermined number of unit pixels are corrected based on the signal average of the plurality of pieces of luminance information.

In the display (2) according to the above-described embodiment of the disclosure, each of the predetermined number of unit pixels belonging to the unit pixel group performs display based on the luminance information. At this time, the luminance information of the focused unit pixel belonging to the unit pixel group is corrected to prevent the luminance of the focused unit pixel from being varied by the luminance information of a unit pixel other than the focused unit pixel.

According to the display (1), the display drive circuit, the display drive method, and the electronic apparatus of the above-described respective embodiments of the disclosure, a signal average of a plurality of pieces of luminance information out of a predetermined number of pieces of luminance information is obtained, and the plurality of pieces of luminance information are corrected based on the signal average, thereby making it possible to improve image quality.

According to the display (2) of the above-described embodiment of the disclosure, luminance information of a focused unit pixel in a unit pixel group is corrected to prevent luminance of the focused unit pixel from being varied by luminance information of a unit pixel other than the focused unit pixel, thereby making it possible to improve image quality.

According to another aspect described herein, correction processing is provided for a display having pixel circuits respectively including a display element and a drive transistor that is configured to provide a drive current to the display element according to a luminance information value. A control transistor is disposed on a current path that provides the drive current to a unit pixel group that includes two or more of the pixel circuits, and a correction processing section is configured to obtain a correction factor that is a function of the luminance information values respectively corresponding to each of the pixel circuits in the unit pixel group, and to perform a correction of the luminance information value for at least one of the pixel circuits in the unit pixel group based on the correction factor.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Hereinafter, an embodiment of the present disclosure will be described in detail with reference to the accompanying drawings. It is to be noted that description is made in the following order.

1. Embodiment
2. Application Examples

[1. Embodiment]

[Exemplary Configuration]

Figure 1:
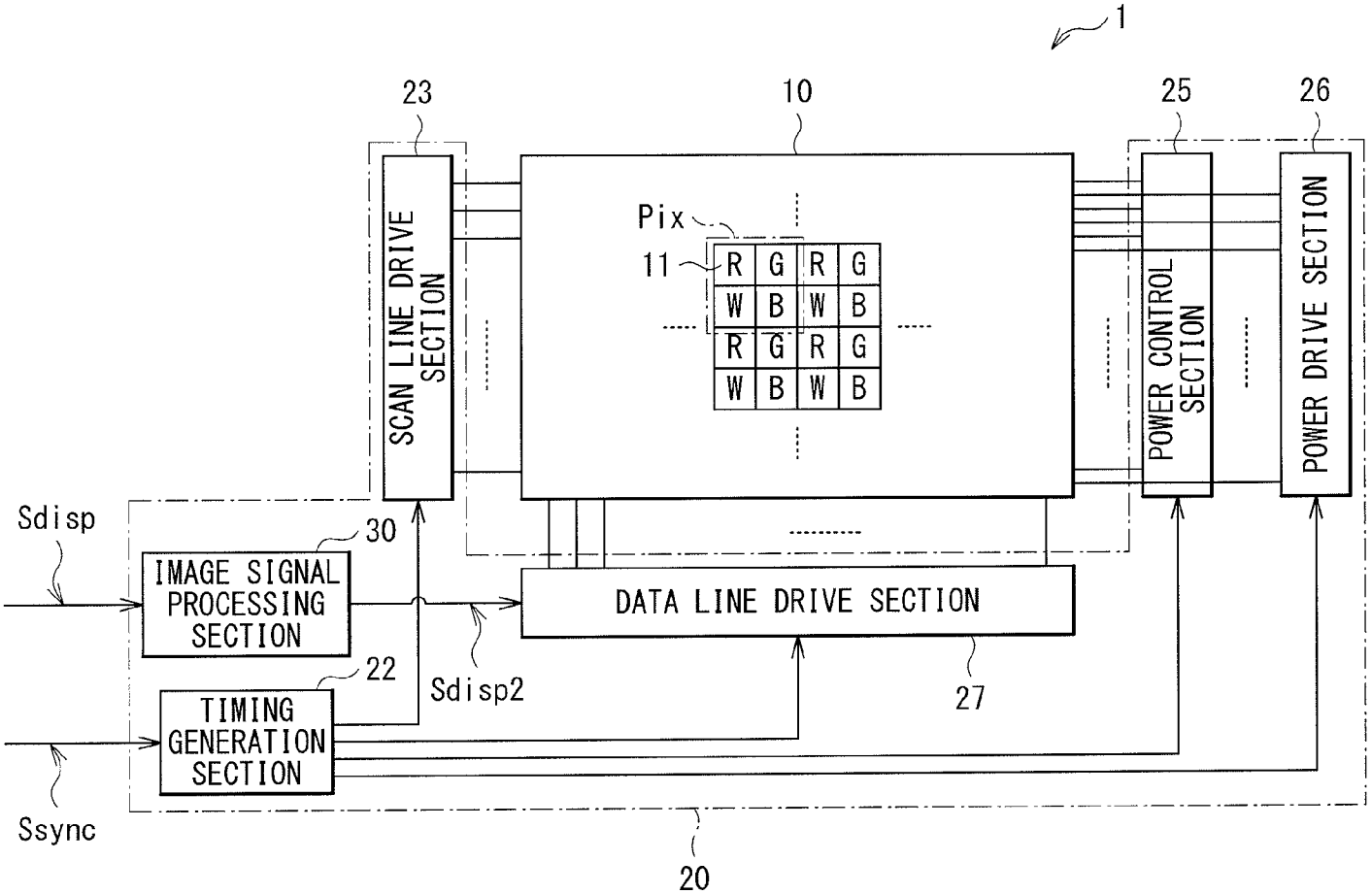
FIG. 1 is a block diagram illustrating an exemplary configuration of a display according to an embodiment of the present disclosure.

FIG. 1 illustrates an exemplary configuration of a display according to an example embodiment. A display 1 is an active-matrix display using an organic EL device. Since a display drive circuit and a display drive method according to respective example embodiments of the disclosure are embodied by the present embodiment, they are described together.

The display 1 includes a display section 10 and a drive section 20. The drive section 20 includes an image signal processing section 30, a timing generation section 22, a scan line drive section 23, a power control section 25, a power drive section 26, and a data line drive section 27.

The display section 10 includes a plurality of pixels Pix arranged in a matrix. Each pixel Pix includes four sub-pixels 11 of red (R), green (G), blue (B), and white (W). In this exemplary case, the four sub-pixels 11 are arranged in a 2×2 matrix in the pixel Pix. Specifically, in the pixel Pix, a red (R) sub-pixel 11 is disposed at the upper left, a green (G) sub-pixel 11 is disposed at the upper right, a white (W) sub-pixel 11 is disposed at the lower left, and a blue (B) sub-pixel 11 is disposed at the lower right. In this exemplary case, M sub-pixels 11 are disposed in a horizontal (lateral) direction, and N sub-pixels 11 are disposed in a vertical (longitudinal) direction in the display section 10.

Figure 2:
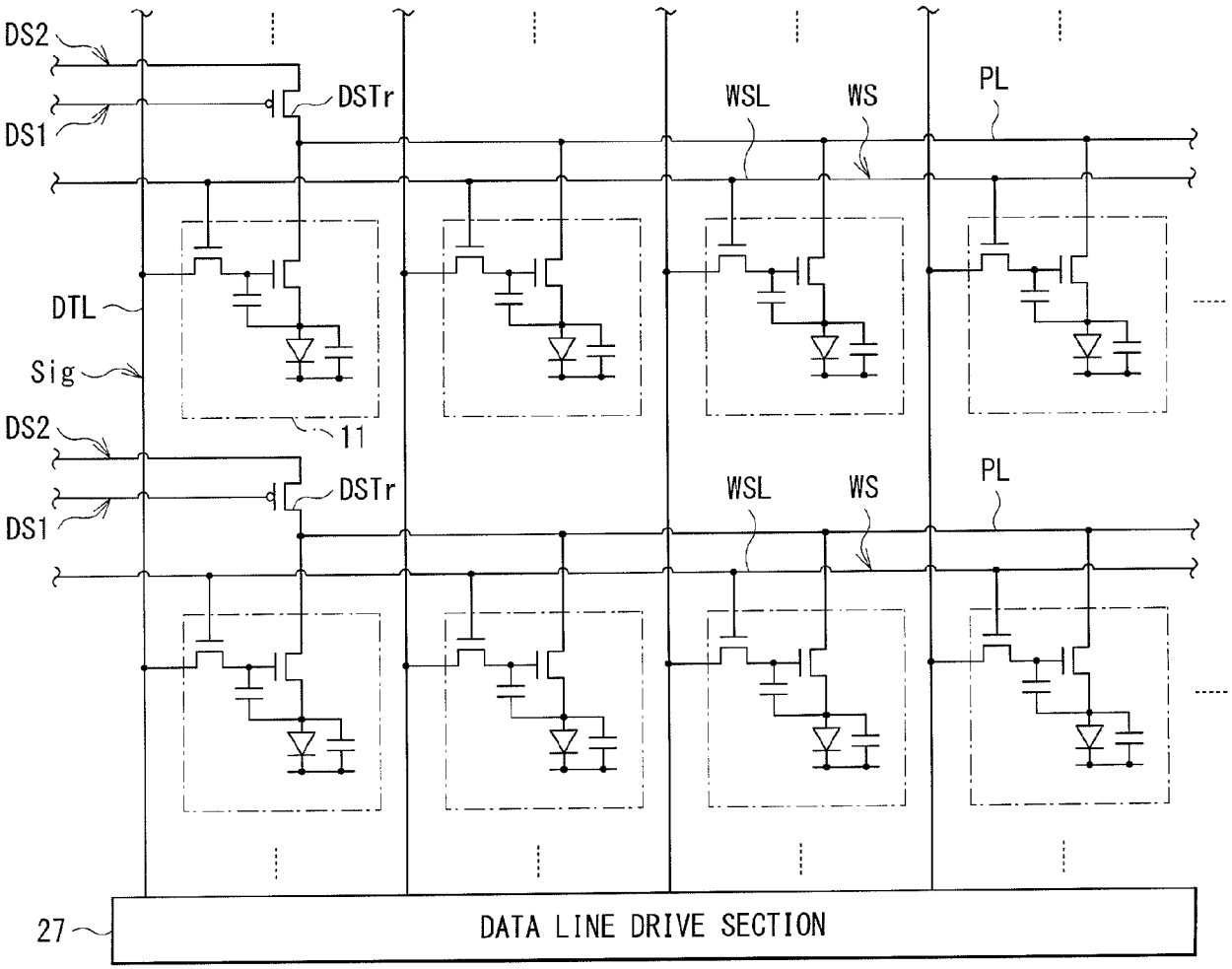
FIG. 2 is a circuit diagram illustrating an exemplary circuit configuration of a display section illustrated in FIG. 1.
Figure 3:
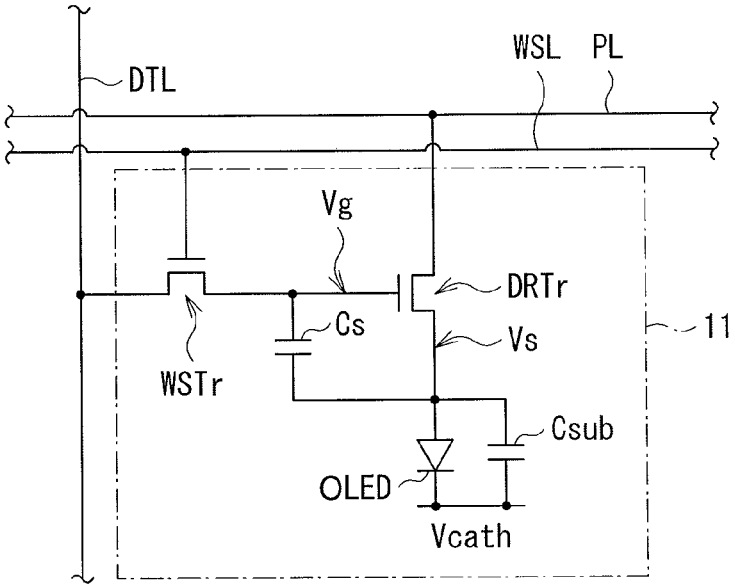
FIG. 3 is a circuit diagram illustrating an exemplary circuit configuration of a sub-pixel illustrated in FIG. 1.

FIG. 2 illustrates an exemplary circuit configuration of the display section 10. FIG. 3 illustrates an exemplary circuit configuration of the sub-pixel 11.

As illustrated in FIG. 2, the display section 10 includes the sub-pixels 11, data lines DTL extending in a column direction, scan lines WSL and power lines PL extending in a row direction, and power supply transistors DSTr. Each sub-pixel 11 is connected to the scan line WSL, the power line PL, and the data line DTL. The scan line WSL is configured to transmit a scan signal WS, and is connected at one end thereof to the undepicted scan line drive section 23. As described later, the data line DTL is configured to transmit a signal Sig containing a pixel voltage Vsig, and is connected at one end thereof to the data line drive section 27. The power line PL is configured to supply power to each sub-pixel 11, and is connected at one end thereof to the power supply transistor DSTr. For example, the power supply transistor DSTr may be configured of a P-channel metal-oxide-semiconductor (MOS) thin film transistor (TFT). Although not shown, the source of the power supply transistor DSTr is connected to the power drive section 26, the gate thereof is connected to the power control section 25, and the drain thereof is connected to the power line PL. The power supply transistor DSTr is connected to (M) sub-pixels 11 corresponding to one line of the display section 10 through the power line PL.

The sub-pixel 11 includes a write transistor WSTr, a drive transistor DRTr, a light emitting device OLED, a capacitor Cs, and a capacitor Csub. For example, the write transistor WSTr and the drive transistor DRTr may each be configured of an N-channel MOS TFT. The gate of the write transistor WSTr is connected to the scan line WSL, the source thereof is connected to the data line DTL, and the drain thereof is connected to the gate of the drive transistor DRTr and a first end of the capacitor Cs. The gate of the drive transistor DRTr is connected to the drain of the write transistor WSTr and the first end of the capacitor Cs, the drain thereof is connected to the power line PL, and the source thereof is connected to a second end of the capacitor Cs, a first end of the capacitor Csub, and the anode of the light emitting device OLED. The first end of the capacitor Cs is connected to the gate of the drive transistor DRTr, etc., and the second end thereof is connected to the source of the drive transistor DRTr, etc. The first end of the capacitor Csub is connected to the source of the drive transistor DRTr, the second end of the capacitor Cs, and the anode of the light emitting device OLED, and a second end thereof is configured to receive a predetermined DC voltage Vcath supplied from the drive section 20. The light emitting device OLED is a light emitting device that is formed of an organic EL device and is configured to emit light of a color (one of red, green, blue, and white) corresponding to each sub-pixel 11, and has the anode connected to the source of the drive transistor DRTr, the first end of the capacitor Csub, and the second end of the capacitor Cs, and a cathode that is configured to receive the predetermined DC voltage Vcath supplied from the drive section 20. In other words, the light emitting device OLED is connected in parallel with the capacitor Csub. In this way, the capacitor Csub is provided to make the sum of a capacitance value of an equivalent capacitance between the anode and the cathode of the light emitting device OLED and a capacitance value of the capacitor Csub to be substantially constant regardless of the sub-pixel 11.

In this way, the sub-pixel 11 in this exemplary case has a so-called "2Tr2C" configuration formed of two transistors (the write transistor WSTr and the drive transistor DRTr) and two capacitors Cs and Csub. In the display section 10, the sub-pixels 11 corresponding to one line operate in synchronization with one power supply transistor DSTr for the one line. In other words, from a viewpoint of circuit operation, each sub-pixel 11 operates in the same way as a sub-pixel having a configuration of so-called "3Tr2C" formed of the components of "2Tr2C" and the power supply transistor DSTr.

Figure 4:
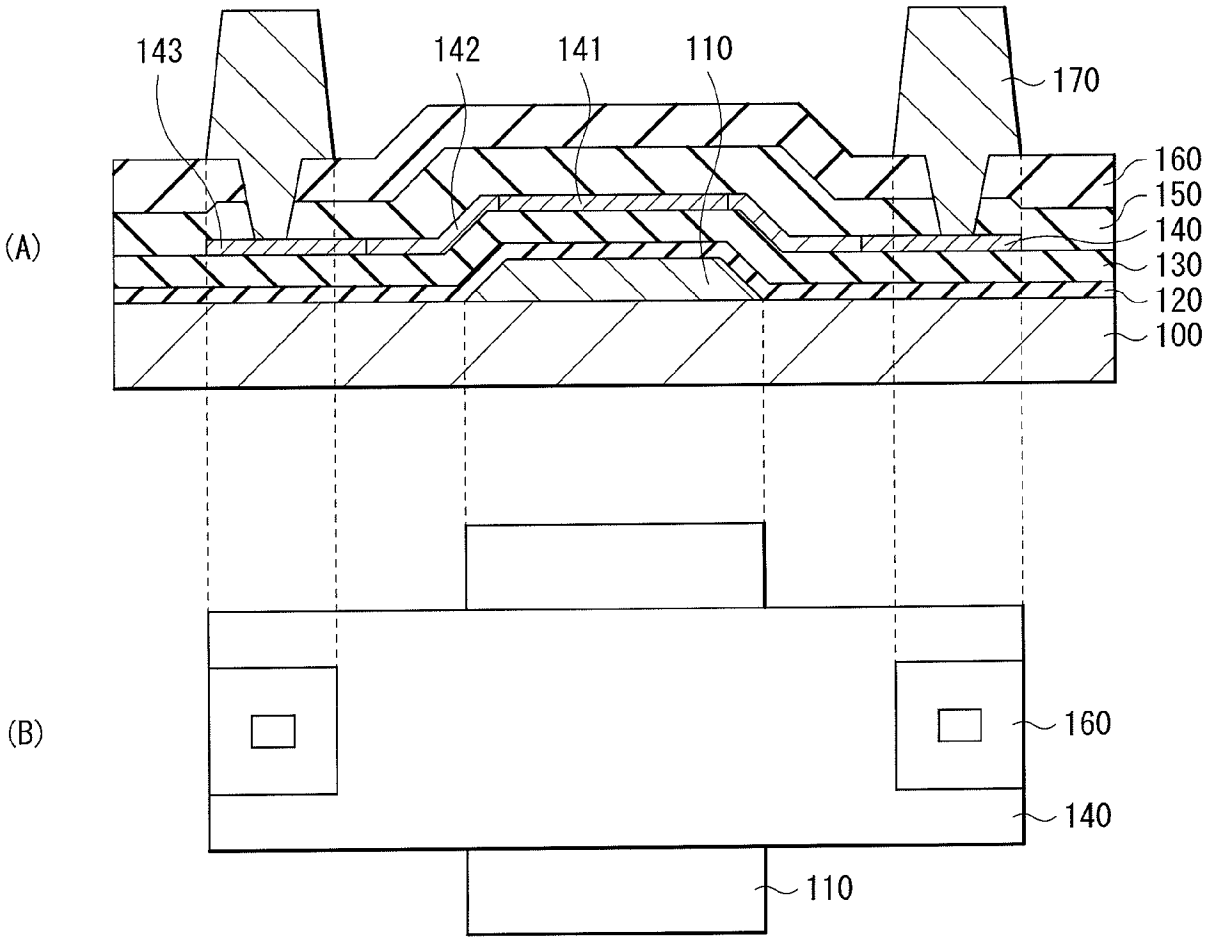
FIG. 4 is an explanatory diagram illustrating an exemplary configuration of a transistor illustrated in FIG. 3.

FIG. 4 illustrates an exemplary configuration of TFT configuring each of the power supply transistor DSTr, the write transistor WSTr, and the drive transistor DRTr, where (A) illustrates a cross-sectional diagram, and (B) illustrates a relevant-part plan diagram. The TFT includes a gate electrode 110 and a polysilicon layer 140. The gate electrode 110 is provided on a substrate 100 formed of glass, etc. For example, the gate electrode 110 may be formed of molybdenum Mo. Insulating layers 120 and 130 are provided in this order on the gate electrode 110 and the substrate 100. For example, the insulating layer 120 may be formed of silicon nitride (SiNx), and the insulating layer 130 may be formed of silicon oxide ($SiO_2$). The polysilicon layer 140 is provided on the insulating layer 130. As described later, the polysilicon layer 140 is formed by forming an amorphous silicon layer on the insulating layer 130, and performing annealing treatment on the amorphous silicon layer by an ELA unit. The polysilicon layer 140 is configured of a channel region 141, a lightly doped drain (LDD) 142, and a contact region 143. As described later, such regions are formed by implanting ions thereinto by an ion implantation unit or an ion doping unit. In this way, the gate electrode 110 is provided below the polysilicon layer 140 in this exemplary case. In other words, the TFT has a so-called bottom gate structure. Insulating layers 150 and 160 are provided in this order on the polysilicon layer 140 and the insulating layer 130. For example, the insulating layer 150 may be formed of silicon oxide ($SiO_2$) like the insulating layer 130. For example, the insulating layer 160 may be formed of silicon nitride (SiNx) like the insulating layer 120. An interconnection 170 is provided on the insulating layer 160. An opening is provided through the insulating layers 150 and 160 in part of a region corresponding to the contact region 143 of the polysilicon layer 140. The interconnection 170 is provided so as to be connected to the contact region 143 via the opening.

In FIG. 1, the image signal processing section 30 is configured to perform, as described later, RGBW conversion, gamma conversion, and correction of luminance information on an image signal Sdisp supplied from the outside to generate an image signal Sdisp2.

Figure 5:
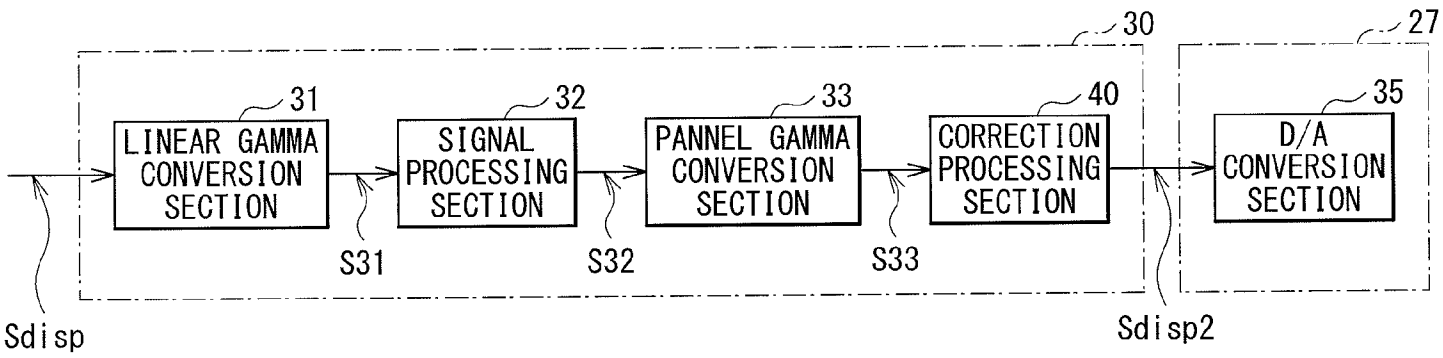
FIG. 5 is a block diagram illustrating an exemplary configuration of an image signal processing section illustrated in FIG. 1.

FIG. 5 illustrates an exemplary configuration of the image signal processing section 30. The image signal processing section 30 includes a linear gamma conversion section 31, a signal processing section 32, a panel gamma conversion section 33, and a correction processing section 40.

The linear gamma conversion section 31 is configured to convert a received image signal Sdisp into an image signal S31 having linear gamma characteristics. Specifically, the externally supplied image signal has nonlinear gamma characteristics in consideration of characteristics of a typical display. Thus, the linear gamma conversion section 31 converts such nonlinear gamma characteristics into linear gamma characteristics to facilitate processing by the signal processing section 32. For example, the gamma conversion section 31 may have a lookup table so as to perform such gamma conversion using the lookup table.

The signal processing section 32 is configured to perform predetermined signal processing such as RGBW conversion on the image signal S31, and outputs results of the signal processing in a form of an image signal S32. Specifically, the signal processing section 32 converts an RGB signal having pieces of luminance information of red (R), green (G), and blue (B) into an RGBW signal having pieces of luminance information of red (R), green (G), blue (B), and white (W). It is to be noted that the signal processing section 32 may further perform any of other types of signal processing such as, for example, color gamut conversion without limitation.

The panel gamma conversion section 33 is configured to convert the image signal S32 having the linear gamma characteristics into an image signal S33 having nonlinear gamma characteristics corresponding to the characteristics of the display section 10 (perform panel gamma conversion). Like the linear gamma conversion section 31, for example, the panel gamma conversion section 33 may have a lookup table so as to perform such gamma conversion using the lookup table.

The correction processing section 40 is configured to correct, for each of lines, luminance information of each sub-pixel 11 contained in the image signal S33. Specifically, the correction processing section 40 obtains an average Avg of pieces of luminance information I(1) to I(M) of (M) sub-pixels 11 corresponding to one line based on the pieces of luminance information I(1) to I(M), and generates pieces of luminance information J(1) to J(M) based on the pieces of luminance information I(1) to I(M) and the average Avg. The correction processing section 40 then outputs such generated pieces of luminance information J(1) to J(M) in a form of the image signal Sdisp2, and supplies the image signal Sdisp2 to a D/A conversion section 35 (described later) of the data line drive section 27. Hereinafter, luminance information I is appropriately used as a representation of any appropriate one of the pieces of luminance information I(1) to I(M). Similarly, luminance information J is appropriately used as a representation of any appropriate one of the pieces of luminance information J(1) to J(M).

Figure 6:
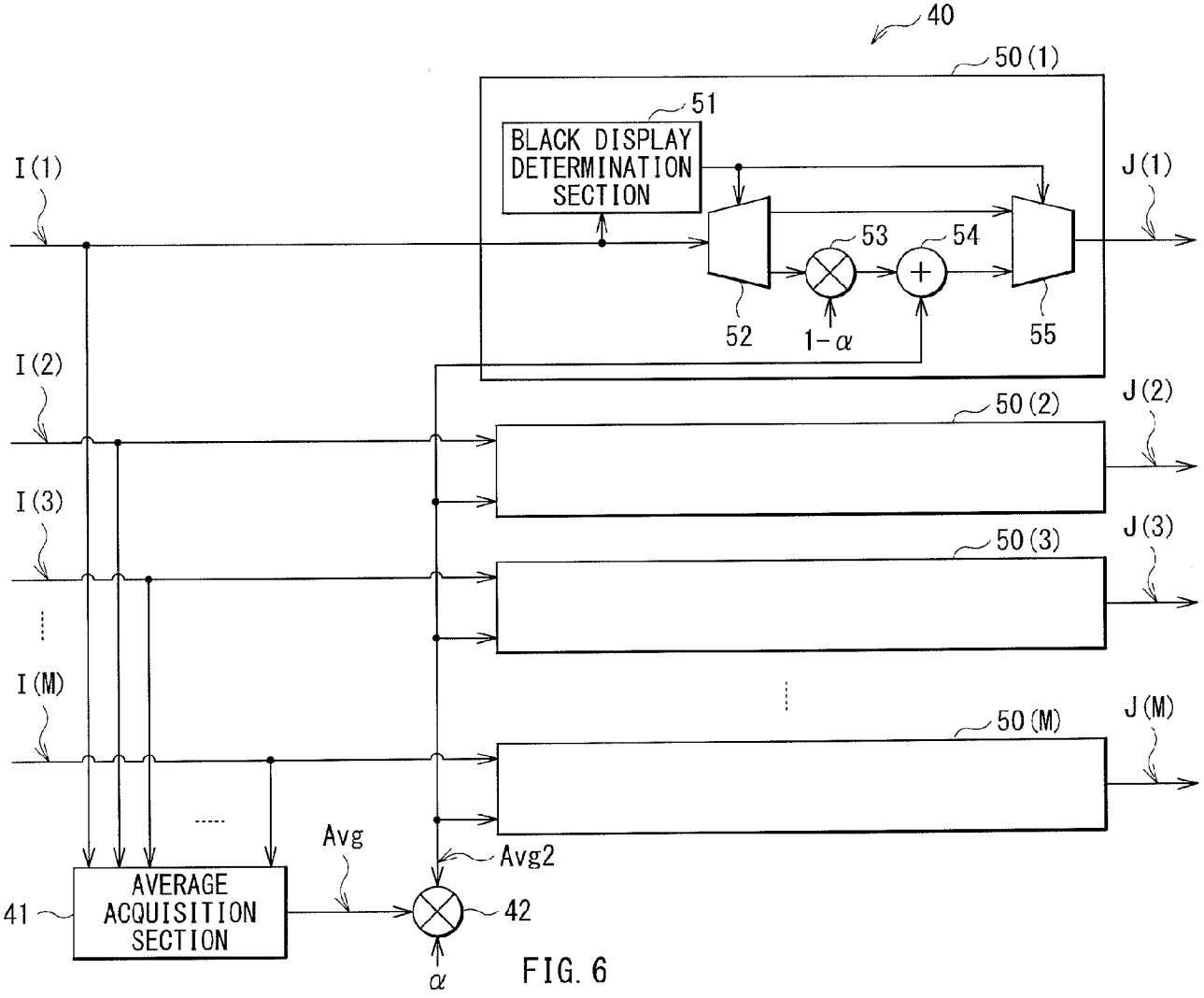
FIG. 6 is a block diagram illustrating an exemplary configuration of a correction processing section illustrated in FIG. 5.

FIG. 6 illustrates an exemplary configuration of the correction processing section 40. The correction processing section 40 is configured to obtain a correction factor that is a function of the luminance information values respectively corresponding to each of the pixel circuits in the unit pixel group, and to perform a correction of the luminance information value for at least one of the pixel circuits in the unit pixel group based on the correction factor. In one example, the correction processing section 40 includes an average acquisition section 41, a multiplication section 42, and M calculation sections 50(1) to 50(M).

The average acquisition section 41 acquires the average Avg of the pieces of luminance information I(1) to I(M). In this operation, the average acquisition section 41 selects luminance information I, which shows a luminance level L (L>Lofs) larger than a luminance level Lofs corresponding to a voltage Vofs described later, among the pieces of luminance information I(1) to I(M), and acquires the average Avg based on the selected luminance information I.

The multiplication section 42 obtains the product (parameter Avg2) of the average Avg acquired by the average acquisition section 41 and a predetermined constant $\alpha$. As described later, the constant $\alpha$ is determined by a plurality of capacitance values (circuit parameters) in the sub-pixel 11, and has a value of 0 to 1 both inclusive.

The calculation sections 50(1) to 50(M) obtain the pieces of luminance information J(1) to J(M) based on the parameter Avg2 and the luminance information I(1) to I(M), respectively. Specifically, for example, the calculation section 50(1) obtains luminance information J(1) based on the luminance information I(1) and the parameter Avg2, and the calculation section 50(2) obtains luminance information J(2) based on the luminance information 42) and the parameter Avg2. Hereinafter, "calculation section 50" is appropriately used as a representation of any appropriate one of the calculation sections 50(1) to 50(M).

The calculation section 50 includes a black display determination section 51, a demultiplexer 52, a multiplication section 53, an addition section 54, and a multiplexer 55. The black display determination section 51 is configured to determine whether or not a luminance level L of luminance information I is larger than the luminance level Lofs. The demultiplexer 52 selects a supply destination of received luminance information I based on a determination result of the black display determination section 51. Specifically, when the luminance level L is equal to or lower than the luminance level Lofs, the demultiplexer 52 supplies the received luminance information I to the multiplexer 55. When the luminance level L is larger than the luminance level Lofs, the demultiplexer 52 supplies the received luminance information I to the multiplication section 53. The multiplication section 53 is configured to obtain the product of the luminance information I supplied from the demultiplexer 52 and a predetermined constant $(1-\alpha)$. The addition section 54 is configured to obtain the sum of the multiplication result of the multiplication section 53 and the parameter Avg2. The multiplexer 55 is configured to select one of two pieces of received information based on the determination result of the black display determination section 51, and output the selected information as the luminance information J. Specifically, when the luminance level L is equal to or lower than the luminance level Lofs, the multiplexer 55 selects and outputs the information supplied from the demultiplexer 52. When the luminance level L is larger than the luminance level Lofs, the multiplexer 55 outputs the information supplied from the addition section 54.

Through such a configuration, when the luminance level L of the luminance information I is equal to or lower than the luminance level Lofs, the calculation section 50 directly outputs the received luminance information I as the luminance information J. When the luminance level L is larger than the luminance level Lofs, the calculation section 50 outputs, as the luminance information J, the result of calculation performed by the multiplication section 53 and the addition section 54 based on the received luminance information I and the parameter Avg2.

Although description has been conveniently made with FIG. 6 assuming that each block, i.e., hardware, performs such calculation processing, part or all of such a block may be configured by software performing similar calculation processing without limitation.

In FIG. 1, the timing generation section 22 is a circuit that is configured to supply a control signal to each of the scan line drive section 23, the power control section 25, the power drive section 26, and the data line drive section 27 so as to control the sections to operate in synchronization with one another, in response to a synchronization signal Ssync supplied from the outside.

The scan line drive section 23 is configured to sequentially apply scan signals WS to a plurality of scan lines WSL to sequentially select a sub-pixel 11, in response to the control signal supplied from the timing generation section 22.

The power control section 25 is configured to sequentially apply power control signals DS1 to the gates of a plurality of power supply transistors DSTr to control light emitting operation and extinction operation of the sub-pixel 11, in response to a control signal supplied from the timing generation section 22.

The power drive section 26 is configured to sequentially apply power signals DS2 to the sources of the plurality of power supply transistors DSTr to control the light emitting operation and the extinction operation of the sub-pixel 11, in response to the control signal supplied from the timing generation section 22. The power signal DS2 is shifted between a voltage Vccp and a voltage Vini. As described later, the voltage Vini is a voltage for initialization of the sub-pixel 11, and the voltage Vccp is a voltage that allows a current Ids to flow through the drive transistor DRTr to induce light emission of the light emitting device OLED.

The data line drive section 27 is configured to generate a signal Sig containing a pixel voltage Vsig that instructs emission luminance of each sub-pixel 11 and the voltage Vofs for Vth correction described later, and apply the signal Sig to each data line DTL, in response to the image signal Sdisp2 supplied from the image signal processing section 30 and the control signal supplied from the timing generation section 22. As illustrated in FIG. 5, the data line drive section 27 includes the digital to analog (D/A) conversion section 35. The D/A conversion section 35 converts the luminance information J as a digital signal contained in the image signal Sdisp2 into the pixel voltage Vsig as an analog signal. In this operation, the D/A conversion section 35 converts the luminance information J into the pixel voltage Vsig according to linear conversion characteristics.

Through such a configuration, as described later, the drive section 20 performs correction (Vth correction), which is to suppress influence of element variations in the drive transistor DRTr on image quality, on the sub-pixel 11, and then writes the pixel voltage Vsig to the sub-pixel 11. In such operation, the drive section 20 generates the pixel voltage Vsig based on the luminance information J generated by the correction processing section 40, and writes the pixel voltage Vsig to the sub-pixel 11. Consequently, the display 1 allows each sub-pixel 11 to emit light with desired luminance as described later.

The sub-pixel 11 corresponds to a specific but not limitative example of "unit pixel" of the disclosure. The light emitting device OLED corresponds to a specific but not limitative example of "display device" of the disclosure. The power supply transistor DSTr corresponds to a specific but not limitative example of "control transistor" of the disclosure. The data line drive section 27 corresponds to a specific but not limitative example of "drive section" of the disclosure.

[Operation and Functions]

Operation and functions of the display 1 of this embodiment are now described.

(Summary of Overall Operation)

First, summary of overall operation of the display 1 is described with reference to FIG. 1, etc. The image signal processing section 30 performs correction of luminance information, etc. on the image signal Sdisp supplied from the outside to generate the image signal Sdisp2. In response to the synchronization signal Ssync supplied from the outside, the timing generation section 22 supplies the control signal to each of the scan line drive section 23, the power control section 25, the power drive section 26, and the data line drive section 27 so as to control the sections to operate in synchronization with one another. In response to the control signal supplied from the timing generation section 22, the scan line drive section 23 sequentially applies scan signals WS to the plurality of scan lines WSL to sequentially select the sub-pixels 11. In response to the control signal supplied from the timing generation section 22, the power control section 25 sequentially applies the power control signals DS1 to the gates of the plurality of power supply transistors DSTr to control light emitting operation and extinction operation of each sub-pixel 11. In response to the control signal supplied from the timing generation section 22, the power drive section 26 sequentially applies the power signals DS2 to the sources of the plurality of power supply transistors DSTr to control light emitting operation and extinction operation of each sub-pixel 11. The data line drive section 27 generates the signal Sig containing the pixel voltage Vsig corresponding to luminance of each sub-pixel 11 and the voltage Vofs for Vth correction, and applies the signal Sig to each data line DTL, in response to the image signal Sdisp2 supplied from the image signal processing section 30 and the control signal supplied from the timing generation section 22. The display section 10 performs display based on the scan signal WS, the power control signal DS1, the power signal DS2, and the signal Sig supplied from the drive section 20.

(Detailed Operation)

Figure 7:
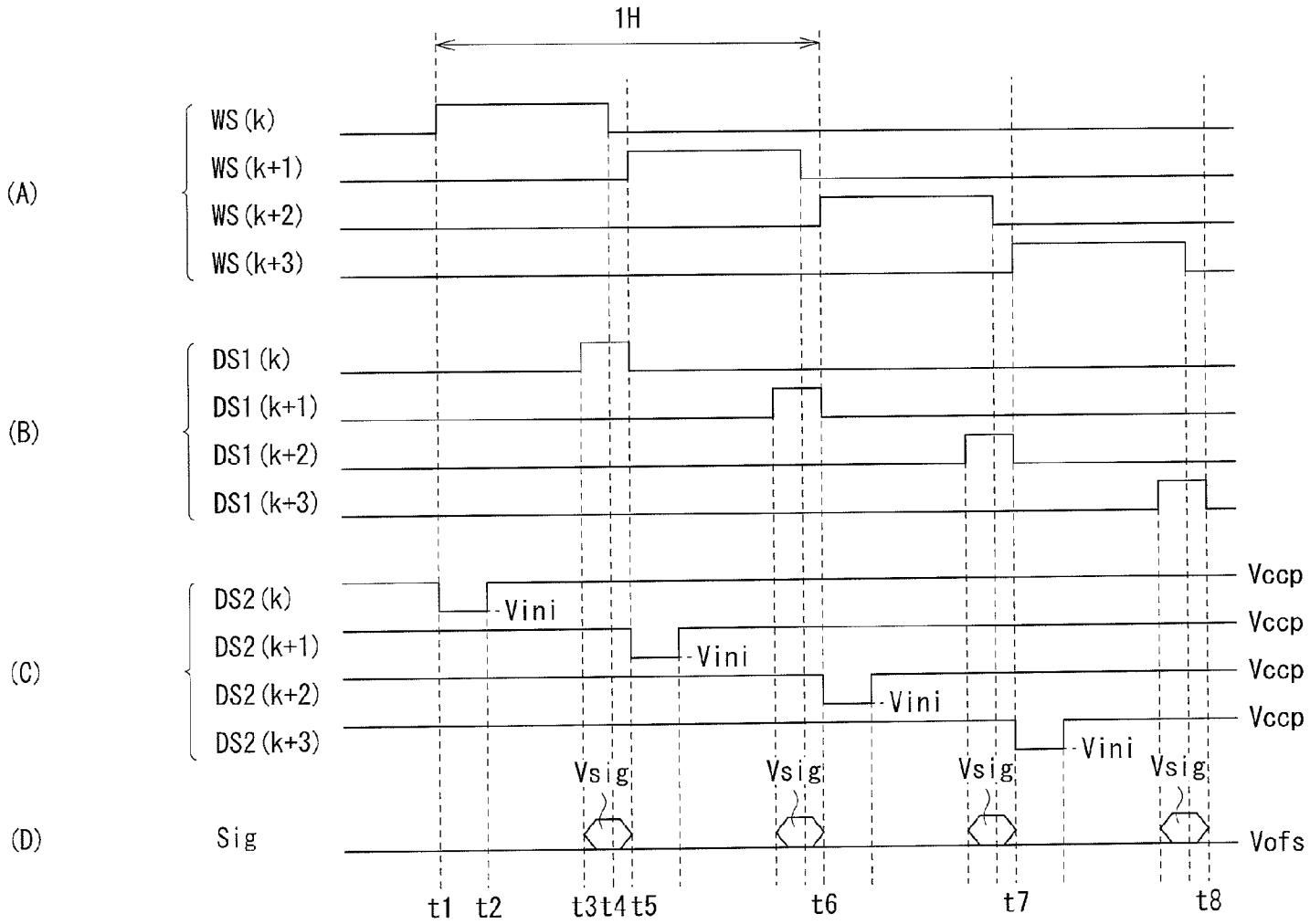
FIG. 7 is a timing waveform chart illustrating an exemplary operation of a drive section illustrated in FIG. 1.

FIG. 7 illustrates a timing chart of operation of the drive section 20, where (A) illustrates waveforms of a scan signal WS, (B) illustrates waveforms of a power control signal DS1, (C) illustrates waveforms of a power signal DS2, and (D) illustrates a waveform of a signal Sig. In (A) of FIG. 7, for example, a scan signal WS (k) represents a scan signal WS driving the sub-pixels 11 on a kth line, and a scan signal WS (k+1) represents a scan signal WS driving the sub-pixels 11 on a (k+1)th line. The same holds true for each of the power control signal DS1 ((B) of FIG. 7) and the power signal DS2 ((C) of FIG. 7).

The scan line drive section 23 of the drive section 20 sequentially applies pulsed scan signals WS to the scan lines WSL ((A) of FIG. 7). The power control section 25 applies, to the gate of the drive transistor DSTr, the power control signal DS1 that is high only within a predetermined period (timing t3 to timing t5, etc.) containing an end timing of the pulse of the scan signal WS, and is low in other periods ((B)

of FIG. 7). The power drive section 26 applies, to the source of the drive transistor DSTr, the power signal DS2 that has a voltage Vini only within a predetermined period from the start timing of the pulse of the scan signal WS (timing t1 to timing t2, etc.), and has a voltage Vccp in other periods ((C) of FIG. 7). The data line drive section 27 applies, to each data line DTL, the pixel voltage Vsig in a period where the power control signal DS1 is high (timing t3 to timing t5, etc.), and applies the voltage Vofs in other periods ((D) of FIG. 7).

Two sub-pixels 11A and 11B belonging to a particular line are now focused, and operation thereof are described in detail.

Figure 8:
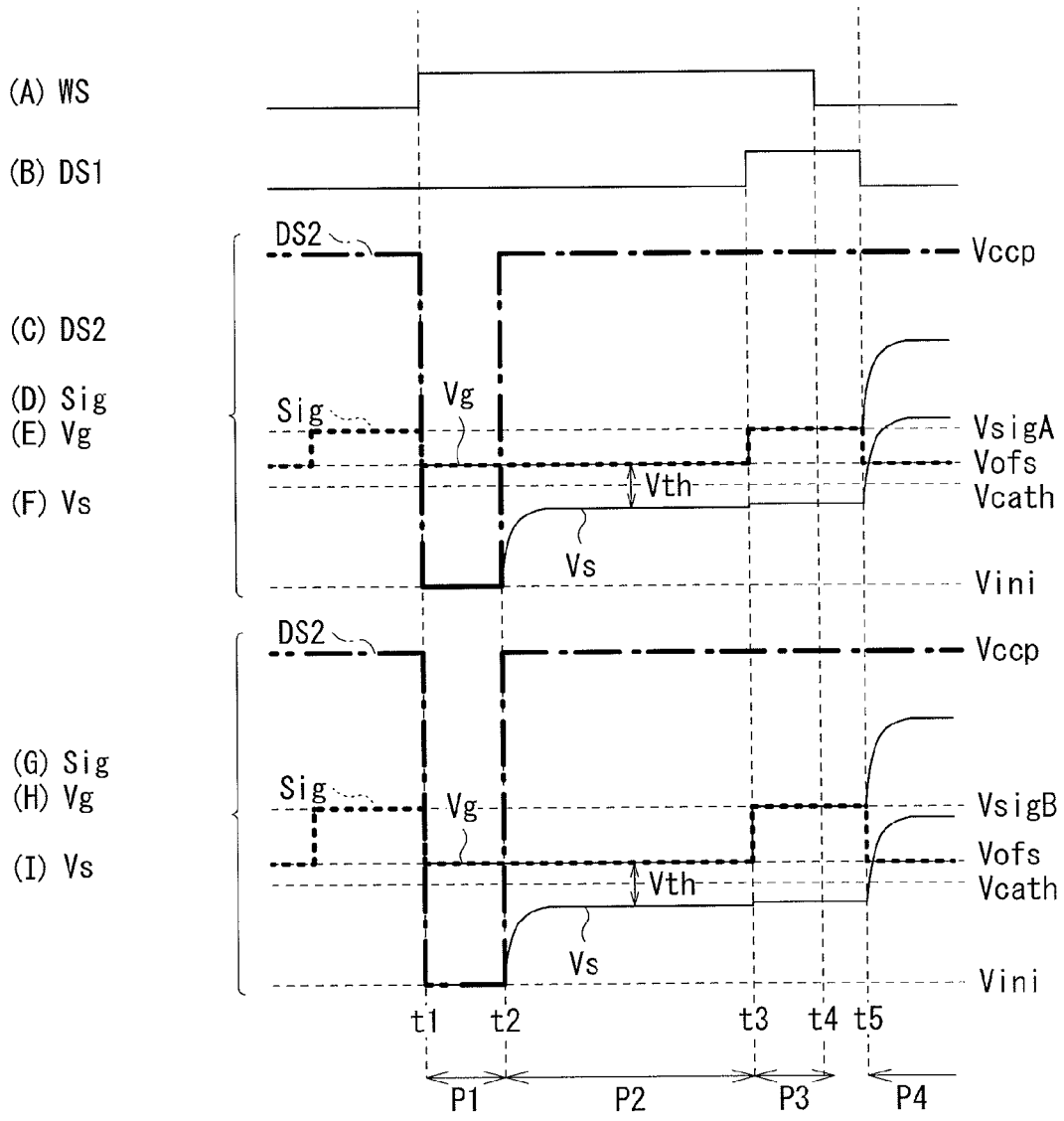
FIG. 8 is a timing waveform chart illustrating an exemplary operation of the display illustrated in FIG. 1.

FIG. 8 illustrates a timing chart of operation of each of the sub-pixels 11A and 11B within a period of timing t1 to timing t5, where (A) illustrates a waveform of the scan signal WS, (B) illustrates a waveform of the power control signal DS1, (C) illustrates a waveform of the power signal DS2, (D) illustrates a waveform of a signal Sig supplied to the sub-pixel 11A, (E) illustrates a waveform of a gate voltage Vg of the drive transistor DRTr in the sub-pixel 11A, (F) illustrates a waveform of a source voltage Vs of the drive transistor DRTr in the sub-pixel 11A, (G) illustrates a waveform of a signal Sig supplied to the sub-pixel 11B, (H) illustrates a waveform of a gate voltage Vg of the drive transistor DRTr in the sub-pixel 11B, and (I) illustrates a waveform of a source voltage Vs of the drive transistor DRTr in the sub-pixel 11B. In (C) to (F) of FIG. 8, the waveforms are shown using the same voltage axis. Similarly, in (G) to (I) of FIG. 8, the waveforms are shown using the same voltage axis. It is to be noted that the same waveform as that of the power signal DS2 ((C) of FIG. 8) is shown on the same voltage axis as that of the waveform in each of (G) to (I) of FIG. 8, for convenience of description.

The drive section 20 performs initialization of each of the sub-pixels 11A and 11B (an initialization period P1), performs Vth correction that is to suppress influence of element variations in the drive transistor DRTr on image quality (a Vth correction period P2), and writes a pixel voltage Vsig to each of the sub-pixels 11A and 11B (a write period P3). Subsequently, the light emitting device OLED of each of the sub-pixels 11A and 11B emits light with a luminance corresponding to the written pixel voltage Vsig (a light emitting period P4). Drive operation on each of the sub-pixels 11A and 11B is now described in detail.

First, the drive section 20 initializes each of the sub-pixels 11A and 11B in the period of timing t1 to timing t2 (the initialization period P1). Specifically, first, at timing t1, the data line drive section 27 sets the signal Sig to be supplied to each of the sub-pixels 11A and 11B to the voltage Vofs ((D) and (G) of FIG. 8), and the scan line drive section 23 changes the voltage of the scan signal WS from a low level to a high level ((A) of FIG. 8). Consequently, the write transistor WSTr of each of the sub-pixels 11A and 11B is turned on, and thus the gate voltage Vg of the drive transistor DRTr of each of the sub-pixels 11A and 11B is set to the voltage Vofs ((E) and (H) of FIG. 8). Concurrently, the power drive section 26 changes the voltage of the power signal DS2 from the voltage Vccp to the voltage Vini ((C) of FIG. 8). Consequently, each drive transistor DRTr is turned on, so that the source voltage Vs of the drive transistor DRTr is set to the voltage Vini ((F) and (I) of FIG. 8). As a result, in each of the sub-pixels 11A and 11B, a gate-to-source voltage Vgs (=Vofs−Vini) of the drive transistor DRTr is set to a voltage larger than the threshold voltage Vth of the drive transistor DRTr, so that each of the sub-pixels 11A and 11B is initialized.

Subsequently, the drive section 20 performs Vth correction in the period of timing t2 to timing t3 (the Vth correction period P2). Specifically, at timing t2, the power drive section 26 changes a voltage of the power signal DS2 from the voltage Vini to the voltage Vccp ((C) of FIG. 8). Consequently, the drive transistor DRTr of each of the sub-pixels 11A and 11B operates in a saturated region, and thus a current Ids flows from the drain to the source of the drive transistor DRTr, resulting in an increase in source voltage Vs ((F) and (I) of FIG. 8). During this operation, the source voltage Vs is lower than the cathode voltage Vcath of the light emitting device OLED; hence, the light emitting device OLED maintains a reverse bias state, so that no current flows through the light emitting device OLED. As the source voltage Vs increases in this way, the gate-to-source voltage Vgs decreases, and thus the current Ids decreases. Through such negative feedback operation, the current Ids converges toward "0" (zero). In other words, the gate-to-source voltage Vgs of the drive transistor DRTr of each of the sub-pixels 11A and 11B converges so as to be equal to the threshold voltage Vth of the drive transistor DRTr (Vgs=Vth).

Subsequently, the drive section 20 writes the pixel voltage Vsig to each of the sub-pixels 11A and 11B in the period of timing t3 to timing t4 (the write period P3). Specifically, first, at timing t3, the power control section 25 changes the voltage of the power control signal DS1 from a low level to a high level ((B) of FIG. 8). Consequently, the power supply transistor DSTr is turned off. Concurrently, the data line drive section 27 sets the signals Sig to be supplied to the sub-pixels 11A and 11B to pixel voltages Vsig (VsigA and VsigB), respectively, ((D) and (G) of FIG. 8). In this exemplary case, the pixel voltages VsigA and VsigB are each higher than the voltage Vofs, and the pixel voltage VsigA is lower than the pixel voltage VsigB. Consequently, the respective gate voltages Vg of the drive transistors DRTr of the sub-pixels 11A and 11B increase from the voltage Vofs to the pixel voltages Vsig (VsigA and VsigB) ((E) and (H) of FIG. 8). At this time, the source voltage Vs of the drive transistor DRTr of each of the sub-pixels 11A and 11B also slightly increases.

Figure 9:
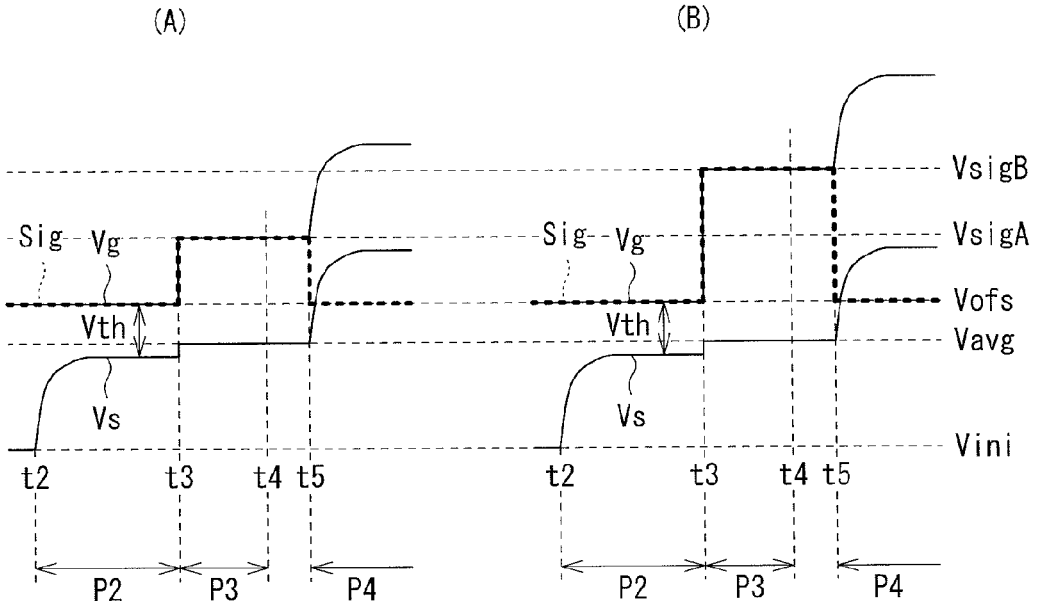
FIG. 9 is a timing waveform chart illustrating an exemplary operation within a write period of the display illustrated in FIG. 1.

FIG. 9 illustrates a timing chart of write operation of the pixel voltage Vsig to each of the sub-pixels 11A and 11B, where (A) illustrates the operation to the sub-pixel 11A, and (B) illustrates the operation to the sub-pixel 11B. The respective gate voltages Vg of the drive transistors DRTr of the sub-pixels 11A and 11B increase from the voltage Vofs to the pixel voltages Vsig (VsigA and VsigB). Accordingly, the respective source voltages Vs of the drive transistors DRTr also slightly increase ((F) and (I) of FIG. 8). At this time, the source voltages Vs are equal to each other, i.e., are each a voltage Vavg. Specifically, in this exemplary case, since the pixel voltages VsigA and VsigB are each higher than the voltage Vofs, the gate-to-source voltage Vgs of the drive transistor DRTr of each of the sub-pixels 11A and 11B is higher than the threshold voltage Vth (Vgs>Vth), and thus the drive transistors DRTr are each turned on. As a result, the respective sources of the drive transistors DRTr of the sub-pixels 11A and 11B are connected to each other via the respective drive transistors DRTr and the power line PL, and the source voltages Vs are equal to each other, i.e., are each the voltage Vavg. Although description has been made on the two sub-pixels 11A and 11B in this exemplary case, the source voltages Vs of the drive transistors DRTr are equal to one another in all sub-pixels 11, which each have the pixel voltage Vsig larger than the voltage Vofs, among sub-pixels 11 belonging to one line.

In the display 1, the correction processing section 40 of the image signal processing section 30 beforehand performs correction processing of luminance information as described later to prevent luminance of each sub-pixel 11 from being varied due to such variations in source voltage Vs.

Subsequently, at timing t4, the scan line drive section 23 changes the voltage of the scan signal WS from a high level to a low level ((A) of FIG. 8). Consequently, the write transistor WSTr of each of the sub-pixels 11A and 11B is turned off, so that the gate of each drive transistor DRTr becomes a floating state, following which an inter-terminal voltage of the capacitive element Cs, i.e., the gate-to-source voltage Vgs of the drive transistor DRTr, is thus maintained.

Subsequently, the drive section 20 allows each of the sub-pixels 11A and 11B to emit light in periods on and after the timing t5 (the light emitting period P4). Specifically, at timing t5, the power control section 25 changes the voltage of the power control signal DS1 from the high level to the low level ((B) of FIG. 8). Consequently, the power supply transistor DSTr is turned on, and the current Ids flows through the drive transistor DRTr of each of the sub-pixels 11A and 11B. Then, as the current Ids flows through each drive transistor DRTr, the source voltage Vs of the drive transistor DRTr increases ((F) and (I) of FIG. 8), and the gate voltage Vg of the drive transistor DRTr accordingly increases ((E) and (H) of FIG. 8). When the source voltage Vs of the drive transistor DRTr becomes larger than the sum (Vel+Vcath) of the threshold voltage Vel of the light emitting device OLED and the voltage Vcath through such bootstrap operation, a current flows between the anode and the cathode of the light emitting device OLED, and thus the light emitting device OLED emits light. In other words, the source voltage Vs increases by an amount of voltage corresponding to the device variations in the light emitting device OLED, and thus the light emitting device OLED emits light.

Thereafter, the display 1 is shifted from the light emission period P3 to the write period P1 after the lapse of a predetermined period (one frame period). The drive section 20 drives the respective sections to repeat such a series of operation.

(Operation of Correction Processing Section 40)

Correction processing of luminance information by the correction processing section 40 is now described. Prior to description of the correction processing, description is first made on write operation assuming that the pixel voltage Vsig1 is generated based on luminance information I before correction.

Figure 10:
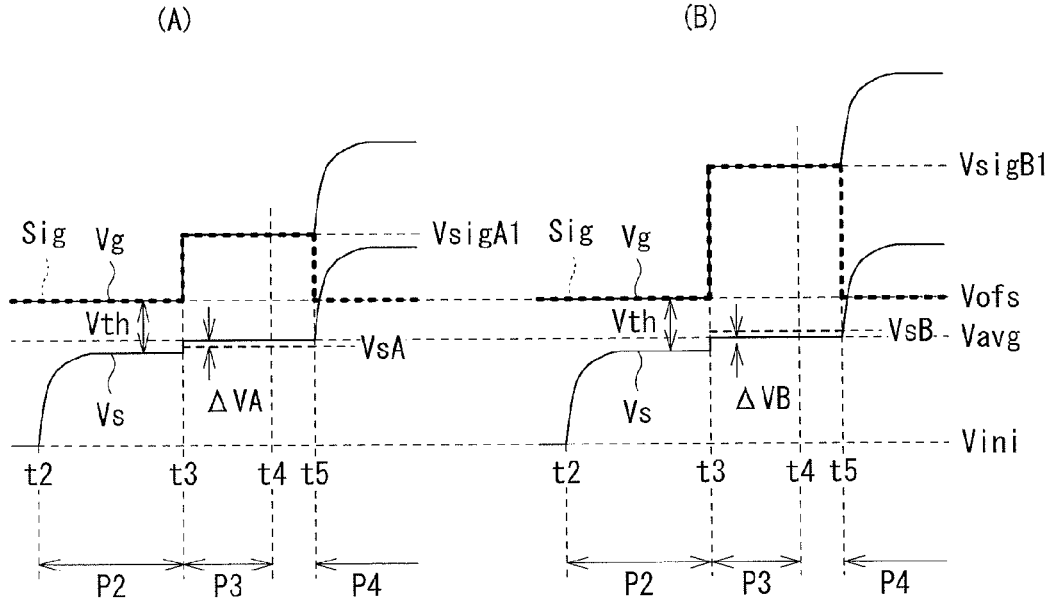
FIG. 10 is an explanatory diagram for explaining averaging of source voltages within the write period.

FIG. 10 illustrates a timing chart of write operation based on the luminance information I before correction (pixel voltage Vsig1), where (A) illustrates the write operation to the sub-pixel 11A, and (B) illustrates the write operation to the sub-pixel 11B. In this exemplary case, a pixel voltage VsigA1 is written to the sub-pixel 11A, and a pixel voltage VsigB1 is written to the sub-pixel 11B. The pixel voltages VsigA1 and VsigB1 are each a voltage corresponding to luminance information I.

At timing t3, when the respective gate voltages Vg of the drive transistors DRTr of the sub-pixels 11A and 11B increase from the voltage Vofs to the pixel voltages VsigA1 and VsigB1, the respective source voltages Vs accordingly begin to be changed into voltages VsA and VsB corresponding to variations in pixel voltages Vsig1. Specifically, the source voltage Vs of the drive transistor DRTr begins to be changed into a level corresponding to each pixel voltage Vsig1 as in the case where each of the sub-pixels 11A and 11B has a so-called "3Tr2C" configuration (a configuration of a comparative example described later (FIG. 18)). However, as described above, since the drive transistors DRTr are turned on in all sub-pixels 11, which each have the pixel voltage Vsig larger than the voltage Vofs, among sub-pixels 11 belonging to the same line as that of the sub-pixels 11A and 11B, the source voltages Vs are equal to one another, i.e., are each the voltage Vavg. The voltage Vavg corresponds to an average of the source voltages Vs of the drive transistors DRTr that have been turned on.

In this way, the source voltages Vs are averaged. Thus, in the sub-pixel 11A, as illustrated in (A) of FIG. 10, the gate-to-source voltage Vgs decreases by an amount corresponding to a potential difference ΔVA (=Vavg−VsA). In the sub-pixel 11B, as illustrated in (B) of FIG. 10, the gate-to-source voltage Vgs increases by an amount corresponding to a potential difference ΔVB (=VsB−Vavg). Specifically, in this state, luminance of the sub-pixel 11A decreases, while luminance of the sub-pixel 11B increases. The correction processing section 40 of the display 1 beforehand determines an amount of voltage corresponding to a shift in source voltage Vs (each of the potential differences ΔVA and ΔVB), such a voltage shift possibly occurring in each of sub-pixels 11, and beforehand corrects luminance information by an amount corresponding to the potential difference, and thus operates to suppress a shift in luminance.

Figure 11:
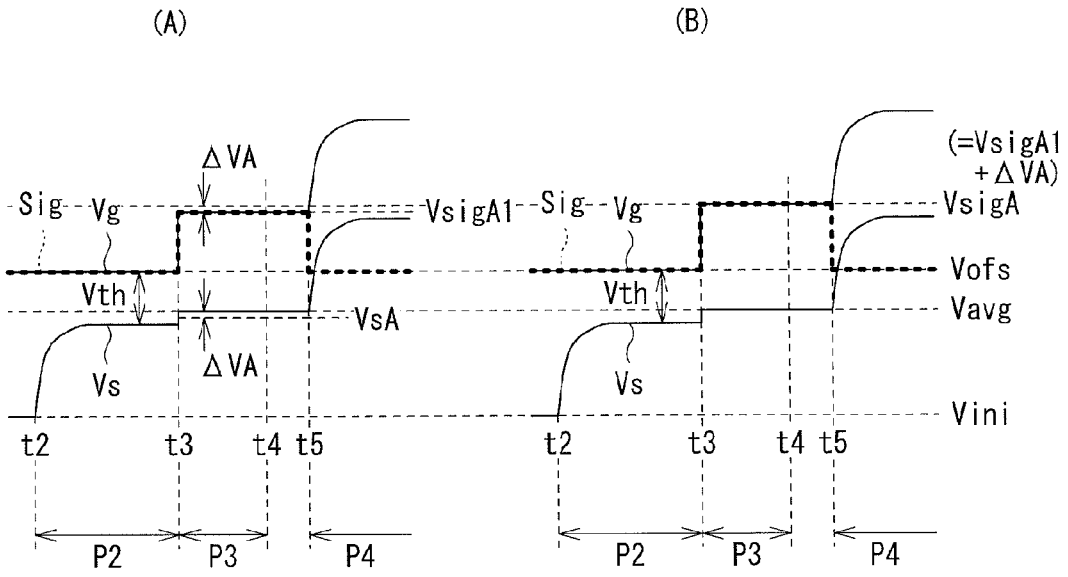
FIG. 11 is an explanatory diagram for explaining correction processing.
Figure 12:
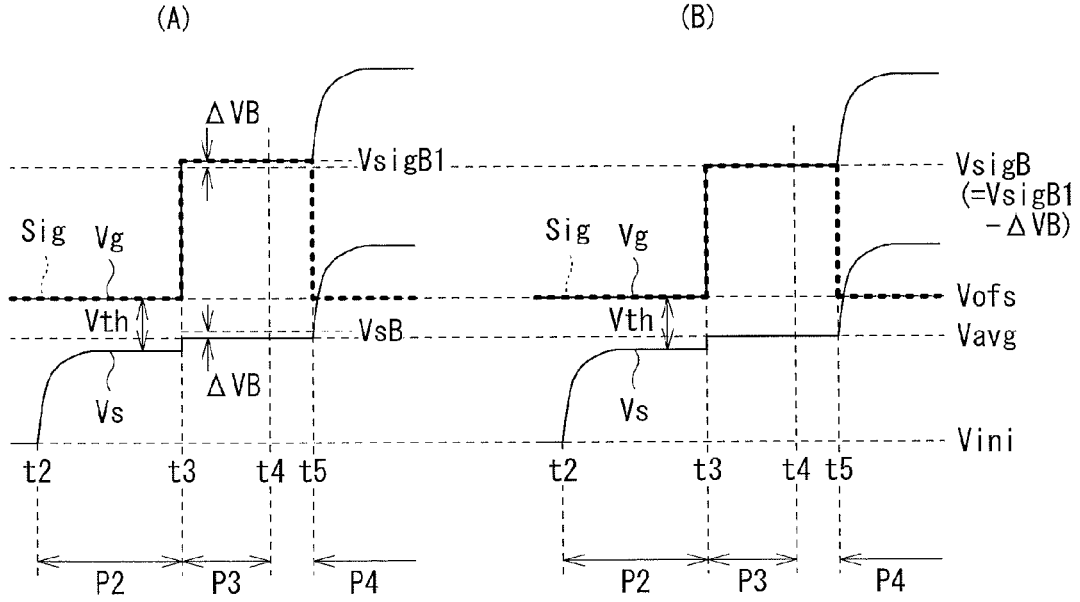
FIG. 12 is another explanatory diagram for explaining the correction processing.

FIG. 11 and FIG. 12 each illustrate an effect of the correction processing by the correction processing section 40, where FIG. 11 illustrates a timing chart of write operation in the sub-pixel 11A, and FIG. 12 illustrates a timing chart of write operation in the sub-pixel 11B. In FIG. 11 and FIG. 12, (A) illustrates write operation based on luminance information I before correction (a pixel voltage Vsig1), while (B) illustrates write operation based on luminance information J after correction (a pixel voltage Vsig).

As described above, for example, when the sub-pixel 11A receives the pixel voltage VsigA1, the gate-to-source voltage Vgs decreases by an amount corresponding to the potential difference ΔVA (=Vavg−VsA) as illustrated in (A) of FIG. 11. Hence, as illustrated in (B) of FIG. 11, the correction processing section 40 corrects the luminance information I into the luminance information J such that the pixel voltage VsigA is a voltage (VsigA1+ΔVA) higher by the amount corresponding to the potential difference ΔVA than the pixel voltage VsigA1. Similarly, when the sub-pixel 11B receives the pixel voltage VsigB1, the gate-to-source voltage Vgs increases by an amount corresponding to the potential difference ΔVB (=VsB−Varg) as illustrated in (A) of FIG. 12. Hence, as illustrated in (B) of FIG. 12, the correction processing section 40 corrects the luminance information I into the luminance information J such that the pixel voltage VsigB is a voltage (VsigB1−ΔVB) lower by the amount corresponding to the potential difference ΔVB than the pixel voltage VsigB1. Consequently, variations in luminance of each sub-pixel 11 due to averaging of the source voltages are suppressed.

In other words, the correction processing section 40 corrects the luminance information to prevent emission luminance of a focused sub-pixel 11 from being varied by luminance information of any of other sub-pixels 11 belonging to the same line. Specifically, for example, in the sub-pixel 11A, the potential difference ΔVA (=Vavg−VsA) is varied by luminance information of any of other sub-pixels 11 belonging to the same line. The correction processing section 40 corrects the luminance information I of the sub-pixel 11A into the luminance information J such that the pixel voltage Vsig is varied by an amount corresponding to the shift in source voltage Vs (potential difference ΔVA) in the sub-pixel 11A. In other words, the correction processing section 40 corrects the luminance information I of the sub-pixel 11A so as to cancel the shift in source voltage Vs in the sub-pixel 11A. Consequently, in the display 1, it is possible to reduce a possibility that luminance of a certain sub-pixel 11 is varied by luminance information of any of other sub-pixels 11 belonging to the same line.

(Correction Expressions for Correction Processing)

Correction expressions for correction processing of luminance information by the correction processing section 40 are now derived. In this exemplary case, description is conveniently made with "pixel voltage Vsig1" in place of "luminance information I before correction" and "pixel voltage Vsig" in place of "luminance information J after correction". Hereinafter, description is conveniently made assuming that any of sub-pixels 11 belonging to one line has a pixel voltage Vsig1 (luminance information I) higher than the voltage Vofs (luminance level Lofs).

Figure 13:
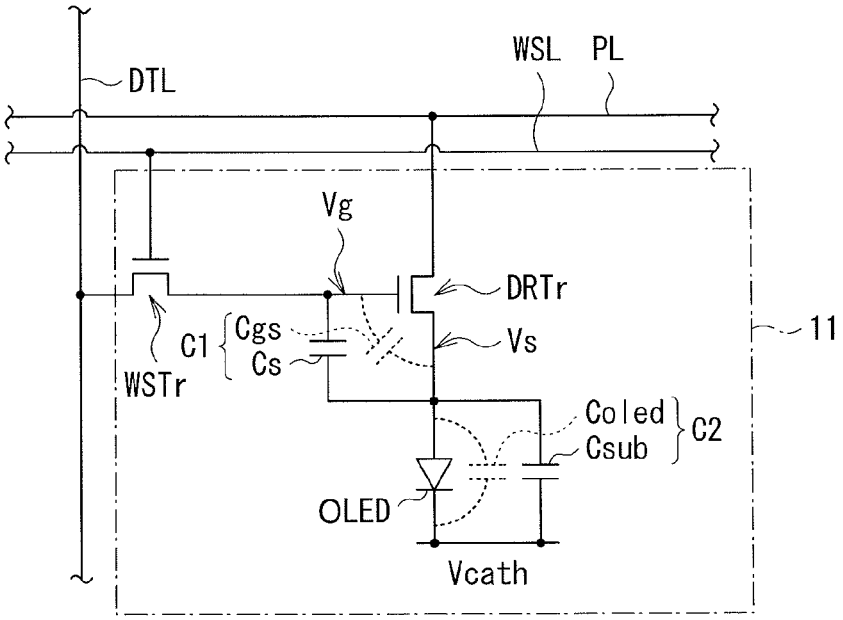
FIG. 13 is an explanatory diagram illustrating an equivalent capacitance of the sub-pixel illustrated in FIG. 3.

FIG. 13 illustrates an equivalent capacitance of the sub-pixel 11. As illustrated in FIG. 13, the drive transistor DRTr has an equivalent capacitance Cgs between the gate and the source thereof. The equivalent capacitance Cgs and the capacitor Cs are connected in parallel, and the sum of the capacitance values thereof is equal to a capacitance value C1. The light emitting device OLED has an equivalent capacitance Coled between the anode and the cathode thereof. The equivalent capacitance Coled and a capacitor Csub are connected in parallel, and the sum of the capacitance values thereof is equal to a capacitance value C2. Hereinafter, description is made assuming that the capacitance value C1 is substantially constant regardless of the sub-pixel 11, and the capacitance value C2 is also substantially constant regardless of the sub-pixel 11. Moreover, the threshold voltages Vth of the drive transistors DRTr of the sub-pixels 11 belonging to one line are assumed to have substantially the same value. As described later, in a manufacturing process, a certain number of sub-pixels 11 corresponding to one line are arranged in a direction that is orthogonal to a scan direction D1 of the ELA unit but equal to a scan direction D2 of the ion implantation unit, thereby making it possible to suppress variations between threshold voltages Vth of the drive transistors DRTr of the sub-pixels 11 belonging to the one line.

First, when a pixel voltage Vsig1(i) is applied to a gate of a drive transistor DRTr of an ith sub-pixel 11 in sub-pixels 11 corresponding to one line, and when source voltages are assumed to be not averaged, a source voltage Vs(i) is determined. The source voltage Vs(i) corresponds to VsA or VsB in FIG. 11. The source voltage Vs(i) is represented by the following expression.

[Numerical Expression (1)]

$$Vs(i) = \frac{C1}{C1+C2}\cdot Vsig1(i) + \frac{C2}{C1+C2}\cdot Vofs - Vth = \alpha\cdot Vsig1(i) + (1-\alpha)\cdot Vofs - Vth \quad (1)$$

where α is a circuit parameter represented by C1/(C1+C2).

The source voltages Vs(i) of the sub-pixels 11 corresponding to one line are averaged through averaging of the source voltages. The resultant voltage Vavg after the averaging is represented by the following expression based on the numerical expression (1).

[Numerical Expression (2)]

$$Vavg = \frac{1}{M}\sum_{i=1}^{M} Vs(i) = \frac{\alpha}{M}\cdot\sum_{i=1}^{M} Vsig1(i) + (1-\alpha)\cdot Vofs - Vth \quad (2)$$

Subsequently, a pixel voltage Vsig(i) after correction is determined. As illustrated in FIG. 11, the pixel voltage Vsig(i) after correction is given by shifting a pixel voltage Vsig1(i) before correction by an amount corresponding to a difference between the source voltage Vs(i) and the voltage Vavg (potential difference ΔVA or ΔVB). The pixel voltage Vsig(i) is represented by the following expression based on the numerical expressions (1) and (2).

[Numerical Expression (3)]

$$Vsig(i) = Vsig(i) - (Vs(i) - Vavg) = (1-\alpha)\cdot Vsig1(i) + \frac{\alpha}{M}\cdot\sum_{i=1}^{M} Vsig1(i) \quad (3)$$

In the numerical expression (3), the pixel voltage Vsig1(i) is replaced with the luminance information I(i) and the pixel voltage Vsig(i) is replaced with the luminance information J(i), and thus the following expression is obtained.

[Numerical Expression (4)]

$$J(i) = (1-\alpha)\cdot I(i) + \frac{\alpha}{M}\cdot\sum_{i=1}^{M} I(i) \quad (4)$$

The correction processing section 40 uses numerical expression (4) obtained in this way to determine, for each of lines, pieces of luminance information J (voltages Vsig(1) to Vsig(M)) based on the pieces of luminance information I (voltages Vsig1(1) to Vsig1(M)) of sub-pixels 11 belonging to one line. Each block of the correction processing section 40 illustrated in FIG. 6 performs calculation processing based on the numerical expression (4). Specifically, the average acquisition section 41 and the multiplication section 42 perform calculation of the second term of the numerical expression (4), and the multiplication section 53 performs calculation of the first term of the numerical expression (4).

Although this exemplary case has been conveniently described assuming that any of the luminance levels of the pieces of luminance information I (pixel voltages Vsig1) of all the sub-pixels 11 belonging to one line is higher than the luminance level Lofs (voltage Vofs), if each of the luminance levels of pieces of luminance information I (pixel voltages Vsig1) of some sub-pixels 11 is equal to or lower than the luminance level Lofs (voltage Vofs), such calculations may be desirably performed to the exclusion of such sub-pixels 11 having low luminance levels. Specifically, when black is displayed, a luminance level of luminance information I may be adjusted to be equal to or lower than the luminance level Lofs to allow the pixel voltage Vsig to be equal to or lower than the voltage Vofs. In a sub-pixel 11 to which such a low pixel voltage Vsig is written, the gate-to-source voltage Vgs of the drive transistor DRTr is lower than the threshold voltage Vth (Vgs<Vth); hence, the drive transistor DRTr is not turned on. Such a sub-pixel 11 therefore does not contribute to averaging of the source voltages. The correction processing by the correction processing section 40 is to correct a shift in source voltage Vs caused by averaging of the source voltages, and therefore if a sub-pixel 11 that does not contribute to averaging of the source voltages is included in sub-pixels to be calculated, correction accuracy may be reduced. Hence, the luminance information I equal to or lower than the luminance level Lofs may be desirably excluded from the pieces of luminance information to be calculated for correction processing so that the sub-pixels 11 that contribute to averaging of the source voltages are exclusively to be calculated.

Specifically, calculation of the numerical expression (4) is exclusively performed on sub-pixels 11, of each of which the luminance level of luminance information I (a pixel voltage Vsig1) is higher than the luminance level Lofs (voltage Vofs), among the sub-pixels 11 corresponding to one line. On the other hand, calculation of the numerical expression (4) may be desirably not performed on sub-pixels 11, of each of which the luminance level of luminance information I is equal to or lower than the luminance level Lofs, so that the luminance information I is directly into the luminance information J. In correspondence to this, in the correction processing section 40 illustrated in FIG. 6, the average acquisition section 41 selects luminance information I, which shows a luminance level L higher than the luminance level Lofs (L>Lofs), among the pieces of luminance information I(1) to I(M), and acquires the average Avg based on the selected luminance information I. The black display determination section 51 determines whether or not a luminance level of luminance information I is larger than the luminance level Lofs, and determines whether or not calculation of the numerical expression (4) is performed on the luminance information I depending on such determination.

In this way, in the display 1, the luminance information is beforehand corrected, thereby making it possible to improve image quality. Specifically, in the case where such correction processing is not performed, the gate-to-source voltage Vgs in each sub-pixel 11 is shifted from a desired value due to averaging of the source voltages; hence, luminance of the sub-pixel 11 may be shifted from a desired value, leading to a possibility of a reduction in image quality. In contrast, in the display 1, the correction processing section 40 beforehand corrects the luminance information so as to cancel the shift in source voltage Vs due to averaging of the source voltages; hence, shift in luminance is reduced, thereby making it possible to suppress reduction in image quality.

(Layout of Drive Transistors DRTr)

In the display 1, as illustrated in FIG. 2, the power supply transistor DSTr is connected to (M) sub-pixels 11 corresponding to one line. In the sub-pixels 11 corresponding to one line, the drive transistors DRTr desirably have substantially the same threshold voltage Vth. Otherwise, for example, within a period of timing t3 to timing t4, the source voltages Vs of the drive transistors DRTr of the sub-pixels 11 corresponding to one line are averaged and thus substantially equal to one another, and thus results of previous Vth correction may be disturbed, leading to a possibility of reduction in image quality.

For example, variations between the threshold voltages Vth of the drive transistors DRTr may be greatly affected by a formation step of the polysilicon layer 140 in a fabrication process of the transistor. In the formation step, first, an amorphous silicon layer is formed on the insulating layer 130 (FIG. 4). Then, the amorphous silicon layer is subjected to annealing treatment by the ELA unit, and thus the polysilicon layer 140 is formed. Then, ions are implanted into the channel region 141 and the LDD 142 of the polysilicon layer 140 by the ion implantation unit. In addition, ions are implanted into the contact region 143 by an ion doping unit. The treatment by the ELA unit and the treatment by the ion implantation unit each have influence on the variations between the threshold voltages Vth of the drive transistors.

Figure 14:
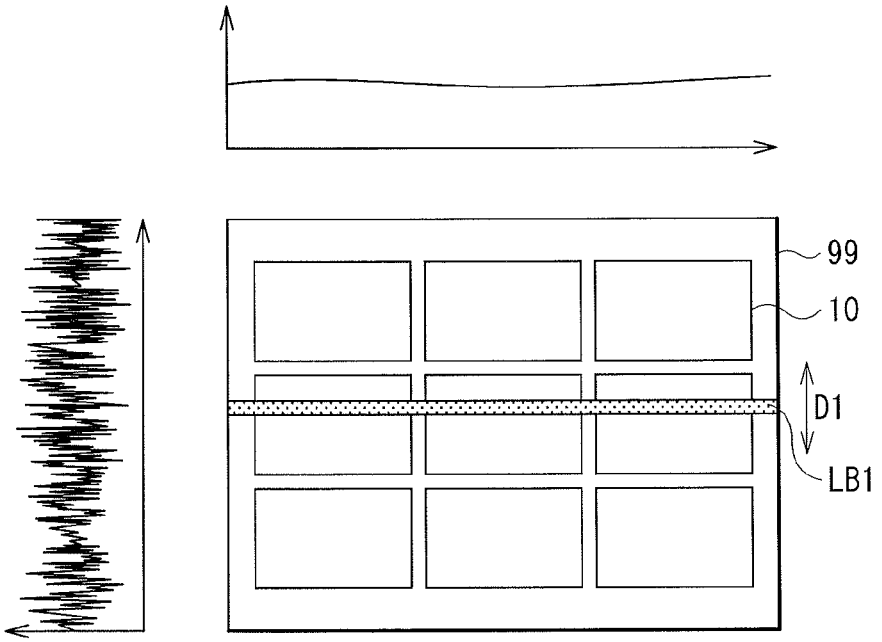
FIG. 14 is a schematic diagram for explaining variations in threshold voltage Vth caused by processing by an excimer laser anneal (ELA) unit.
Figure 15:
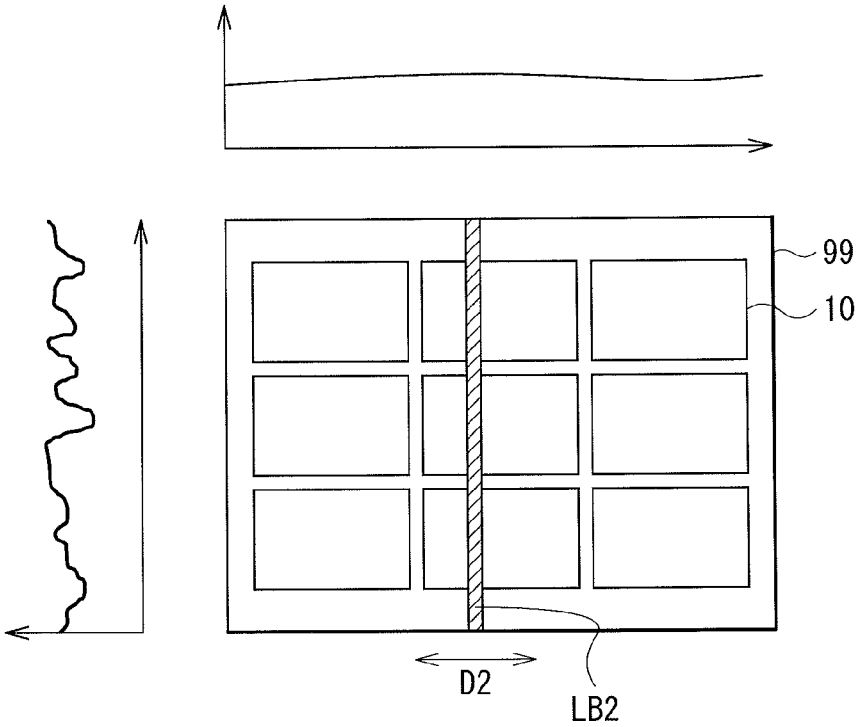
FIG. 15 is a schematic diagram for explaining variations in threshold voltage Vth caused by processing by an ion implantation unit.

FIG. 14 schematically illustrates variations between the threshold voltages Vth caused by the treatment by the ELA unit. FIG. 15 schematically illustrates variations between the threshold voltages Vth caused by the treatment by the ion implantation unit. FIGS. 14 and 15 each illustrate a case where a plurality of display sections 10 is provided on a large glass substrate 99.

As illustrated in FIG. 14, the ELA unit scans the glass substrate 99 in the scan direction D1 while repeatedly turning on and off a strip-shaped laser beam (beam LB1), for example, at about few hundred hertz, and thus performs treatment over the entire surface of the glass substrate 99. At this time, laser energy may be varied every one shot, and variations may accordingly occur between characteristics of transistors adjacent in the scan direction D1. In such a case, the threshold voltage Vth of the transistor may be greatly varied in the scan direction D1 (a longitudinal direction in FIG. 14) compared with in a direction (a lateral direction in FIG. 14) orthogonal to the scan direction D1.

As illustrated in FIG. 15, the ion implantation unit scans the glass substrate 99 in the scan direction D2 while controlling a strip-shaped laser beam (beam LB2) to be continuously ON, and thus performs treatment over the entire surface of the glass substrate 99. In this way, the ion implantation unit continuously outputs the laser beam; hence, variations between characteristics of transistors adjacent in the scan direction D2 are less likely to occur unlike in the case of using the above-described ELA unit. On the other hand, laser energy may not be uniform in a major axis direction (a direction orthogonal to the scan direction D2) of the strip-shaped laser beam, and variations may accordingly occur between characteristics of transistors adjacent in the major axis direction. In such a case, the threshold voltage Vth of the transistor may be greatly varied in the direction (a longitudinal direction in FIG. 15) orthogonal to the scan direction D2 compared with in the scan direction D2 (a lateral direction in FIG. 15).

Thus, as illustrated in FIGS. 14 and 15, the scan direction D1 of the ELA unit and the scan direction D2 of the ion implantation unit are set to be orthogonal to each other, thereby making it possible to suppress variations between the threshold voltages Vth of the transistors arranged in the lateral direction in each of FIGS. 14 and 15.

Figure 16:
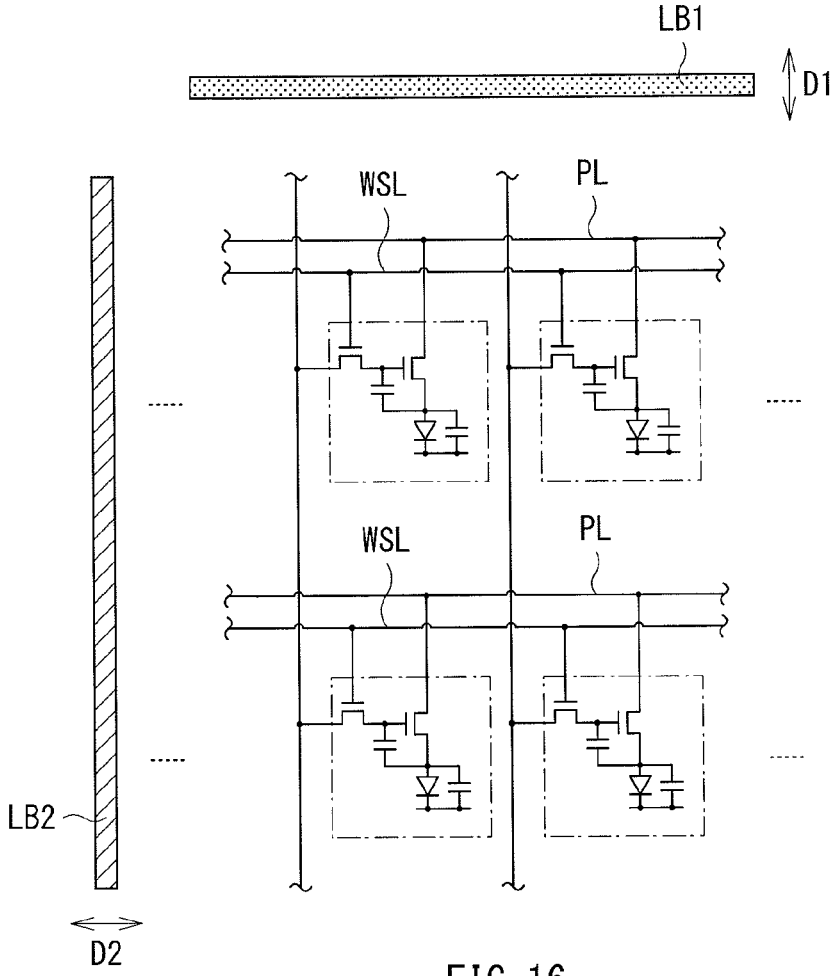
FIG. 16 is an explanatory diagram illustrating a layout of sub-pixels illustrated in FIG. 2.
Figure 17:
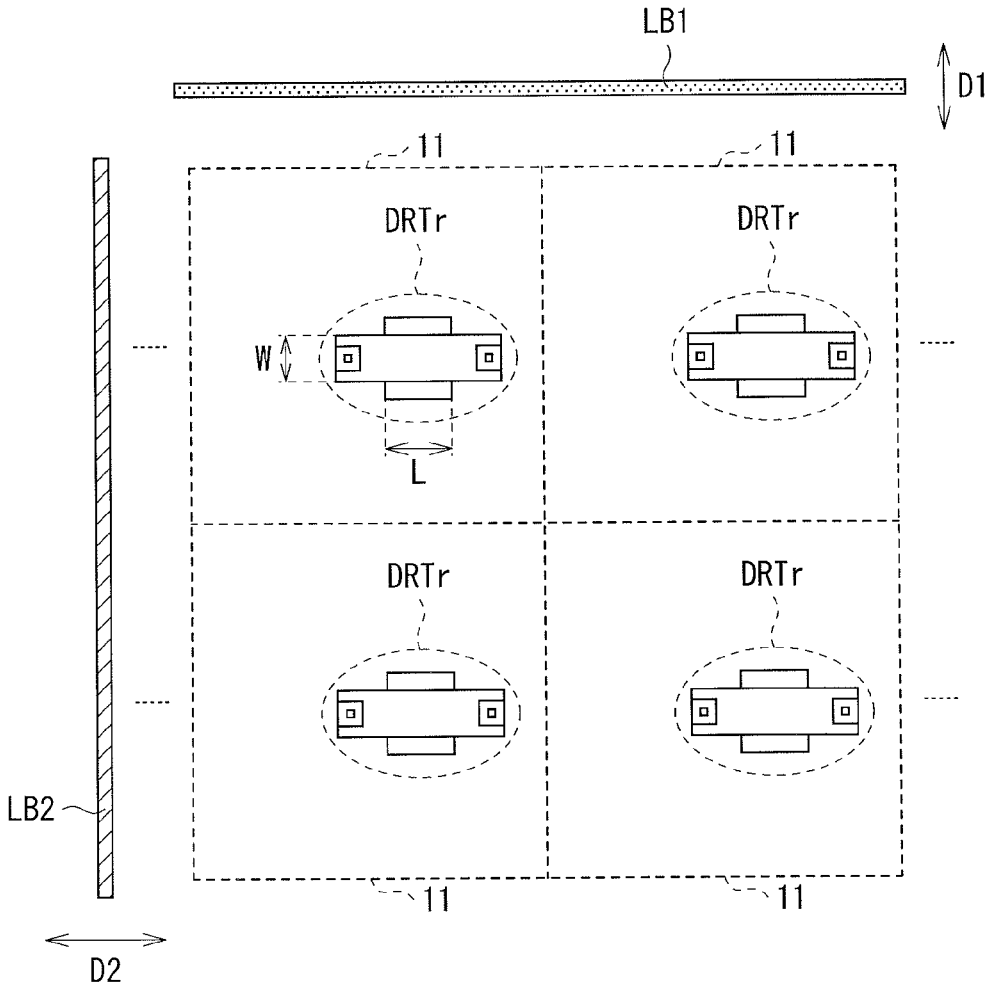
FIG. 17 is an explanatory diagram illustrating a layout of drive transistors illustrated in FIG. 2.

FIG. 16 illustrates a relationship between a layout of sub-pixels 11 and the scan directions D1 and D2 in the display section 10. FIG. 17 illustrates a relationship between a layout of the drive transistors DRTr of the sub-pixels 11 and the scan directions D1 and D2.

As illustrated in FIG. 16, in the display section 10, the sub-pixels 11 corresponding to individual lines are arranged in a direction that is orthogonal to the scan direction D1 but equal to the scan direction D2 (a lateral direction in FIG. 17). Specifically, as illustrated in FIG. 17, the drive transistors DRTr of the sub-pixels 11 corresponding to individual lines are arranged in the direction that is orthogonal to the scan direction D1 but equal to the scan direction D2 (the lateral direction in FIG. 17). Each drive transistor DRTr is disposed such that a channel width (W) direction thereof corresponds to the scan direction D1, and a channel length (L) direction thereof corresponds to the scan direction D2.

In this way, in the display 1, the sub-pixels 11 corresponding to individual lines are arranged in the direction that is orthogonal to the scan direction D1 but equal to the scan direction D2 (the lateral direction in FIG. 17). This allows the threshold voltages Vth of the drive transistors DRTr of the sub-pixels 11 corresponding to one line to be substantially equal to one another, thereby making it possible to reduce a possibility of reduction in image quality.

COMPARATIVE EXAMPLE

A display 1R according to a comparative example is now described. This comparative example is configured such that each sub-pixel 11 includes a power supply transistor DSTr.

Figure 18:
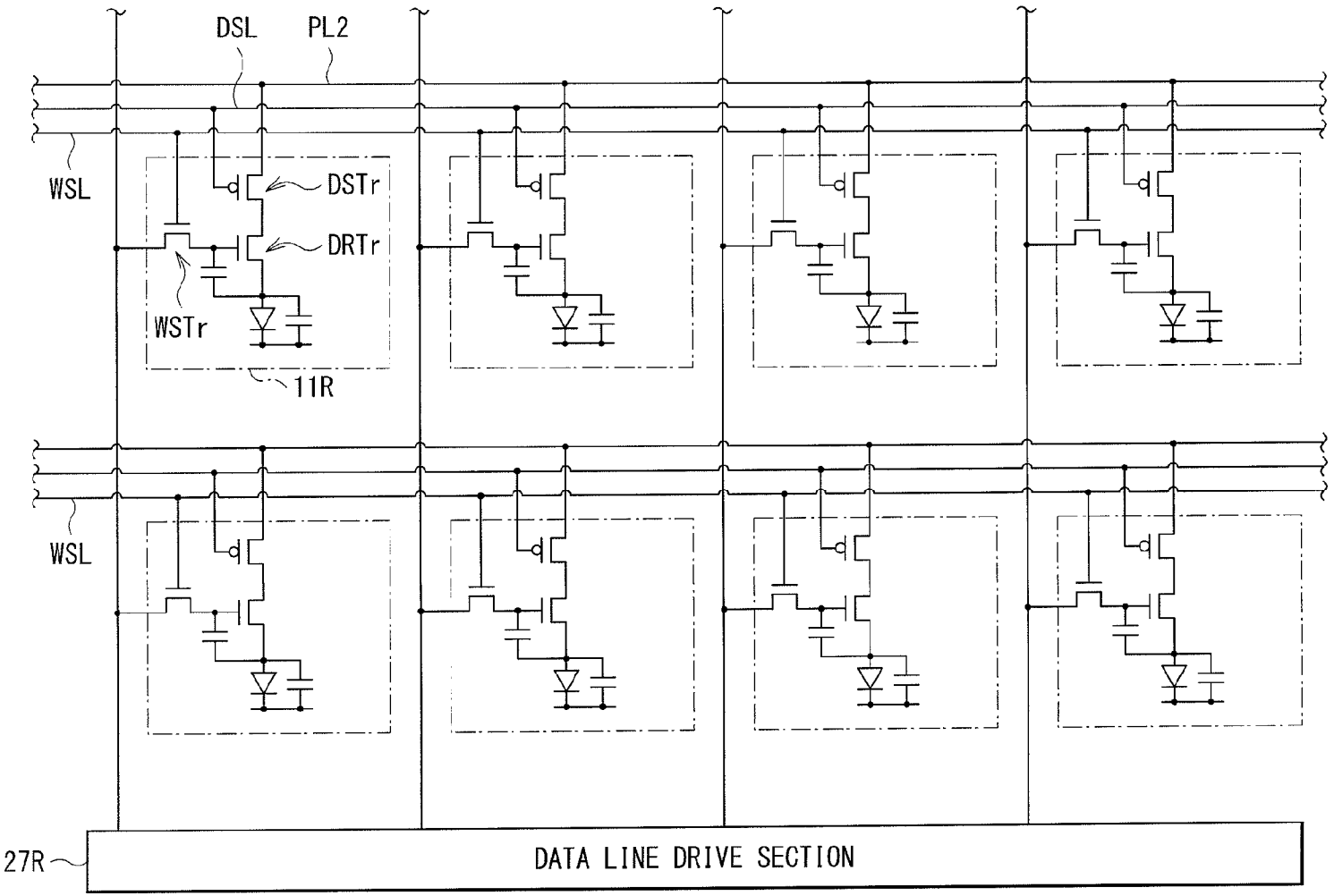
FIG. 18 is a circuit diagram illustrating an exemplary circuit configuration of a display section according to a comparative example.

FIG. 18 illustrates an exemplary circuit configuration of a display section 10R in the display 1R. In the display section 10R, the sub-pixel 11R has a so-called "3Tr2C" configuration formed of three transistors (a write transistor WSTr, a drive transistor DRTr, and a power supply transistor DSTr) and two capacitors. Specifically, although the display section 10 (FIG. 2) according to the above-described embodiment is configured such that the sub-pixel 11 has the "2Tr2C" configuration, and one power supply transistor DSTr is provided for the certain number of sub-pixels 11 corresponding to one line, each sub-pixel 11R includes the power supply transistor DSTr in the display section 10R according to this comparative example.

In this way, in the display section 10R according to the comparative example, any of the sub-pixels 11R has the so-called "3Tr2C" configuration, thereby resulting in an increase in number of transistors. This disadvantageously increases area of a pixel Pix formed of four sub-pixels 11R, and thus resolution is less likely to be increased.

In contrast, in the display section 10 according to the above-described embodiment, one power supply transistor DSTr is provided for the certain number of sub-pixels 11 corresponding to one line, thereby making it possible to decrease the number of transistors. This makes it possible to reduce area of a pixel Pix, thereby leading to an increase in resolution of the display 1.

Advantageous Effects

As described above, in the above-described embodiment, one power supply transistor is provided for the certain number of sub-pixels corresponding to one line, thereby making it possible to increase resolution of the display.

Moreover, in the above-described embodiment, the luminance information is beforehand corrected such that a shift in source voltage due to averaging of the source voltages is cancelled. This makes it possible to reduce a possibility that emission luminance of a focused sub-pixel is varied by luminance information of another sub-pixel belonging to the same line, thereby leading to improvement in image quality. At this time, luminance information of which the luminance level is higher than the luminance level Lofs is exclusively subjected to the correction processing, thereby making it possible to enhance correction accuracy.

Moreover, in the above-described embodiment, the drive transistors of the sub-pixels belonging to individual lines are arranged in a direction that is orthogonal to the scan direction of the ELA unit but equal to the scan direction of the ion implantation unit. This allows the threshold voltages of the drive transistors to be substantially equal to one another, thereby making it possible to suppress reduction in image quality.

[Modification 1]

Although the image signal processing section 30 performs panel gamma conversion in the above-described embodiment, this is not limitative. Alternatively, a data drive section 27 may perform panel gamma conversion. Modification 1 is now described in detail.

Figure 19:
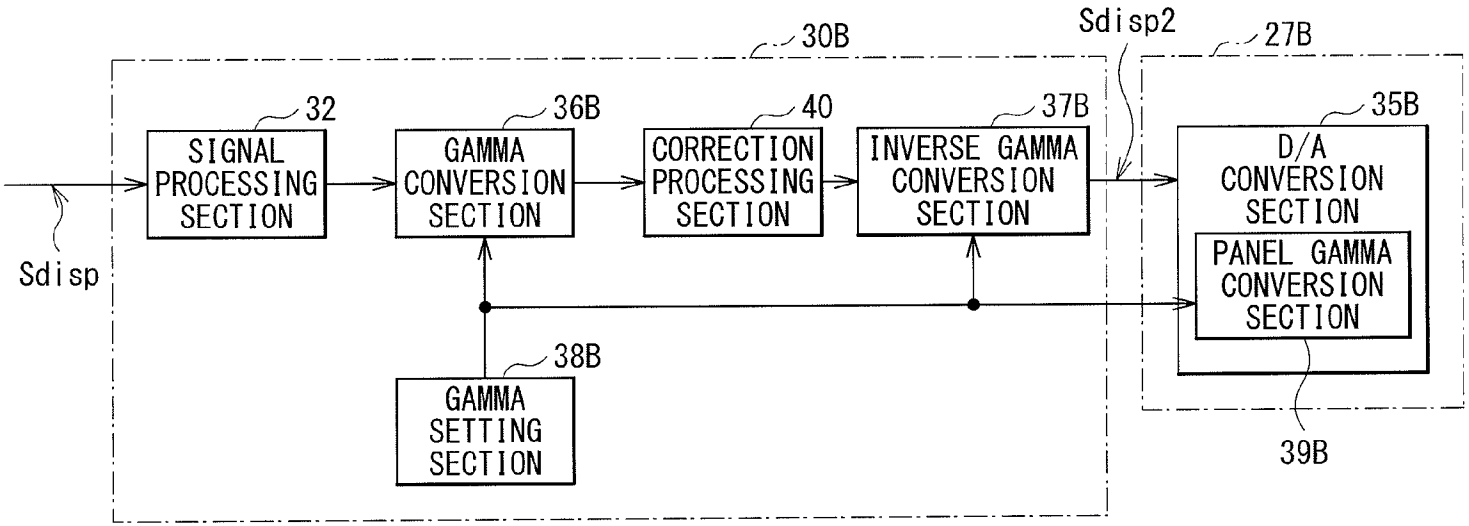
FIG. 19 is a block diagram illustrating an exemplary configuration of an image signal processing section according to a Modification.

FIG. 19 illustrates an image signal processing section 30B and a D/A conversion section 35B of a data line drive section 27B according to the Modification 1. In this exemplary case, the image signal Sdisp is an image signal having linear gamma characteristics.

The image signal processing section 30B includes a gamma conversion section 36B, an inverse gamma conversion section 37B, and a gamma setting section 38B. The gamma conversion section 36B is configured to perform gamma conversion on an image signal supplied from the signal processing section 32 based on an instruction from the gamma setting section 38B. Specifically, the gamma conversion section 36B is configured to perform gamma conversion similar to gamma conversion by a panel gamma conversion section 39B described later. The correction processing section 40 is configured to perform correction processing of luminance information on an image signal supplied from the gamma conversion section 36B. The inverse gamma conversion section 37B is configured to perform gamma conversion, of which the conversion characteristics are opposite to those of the gamma conversion by the gamma conversion section 36B, on an image signal supplied from the correction processing section 40 to generate an image signal Sdisp2. Specifically, in this exemplary case, the image signal Sdisp2 is a signal having linear gamma characteristics. The gamma setting section 38B is configured to instruct appropriate gamma characteristics to each of the gamma conversion section 36B, the inverse gamma conversion section 37B, and the panel gamma conversion section 39B described later.

The D/A conversion section 35B includes the panel gamma conversion section 39B. Like the panel gamma conversion section 33 according to the above-described embodiment, the panel gamma conversion section 39B is configured to convert an image signal having linear gamma characteristics into an image signal having nonlinear gamma characteristics corresponding to the characteristics of the display section 10. In this exemplary case, the panel gamma conversion section 39B is provided integrally with the D/A conversion section 35B. Specifically, the D/A conversion section 35B includes a ladder resistance network, and each of taps of the ladder resistance network is supplied with a tap voltage enabling the gamma characteristics of the panel gamma conversion. The tap voltage is generated based on an instruction from the gamma setting section 38B. Consequently, the D/A conversion section 35B converts the luminance information into the pixel voltage Vsig according to nonlinear conversion characteristics.

Through such a configuration, the correction processing section 33 performs correction processing of the luminance information on a signal having nonlinear gamma characteristics similar to those of a signal subjected to the panel gamma conversion.

[Modification 2]

Although one power supply transistor DSTr is provided for the certain number of sub-pixels 11 corresponding to one line in the above-described embodiment, this is not limitative. Alternatively, for example, one power supply transistor DSTr may be provided for the predetermined number of sub-pixels 11 arranged in a horizontal direction. An exemplary case where one power supply transistor DSTr is provided for two sub-pixels 11 is now described in detail.

Figure 20:
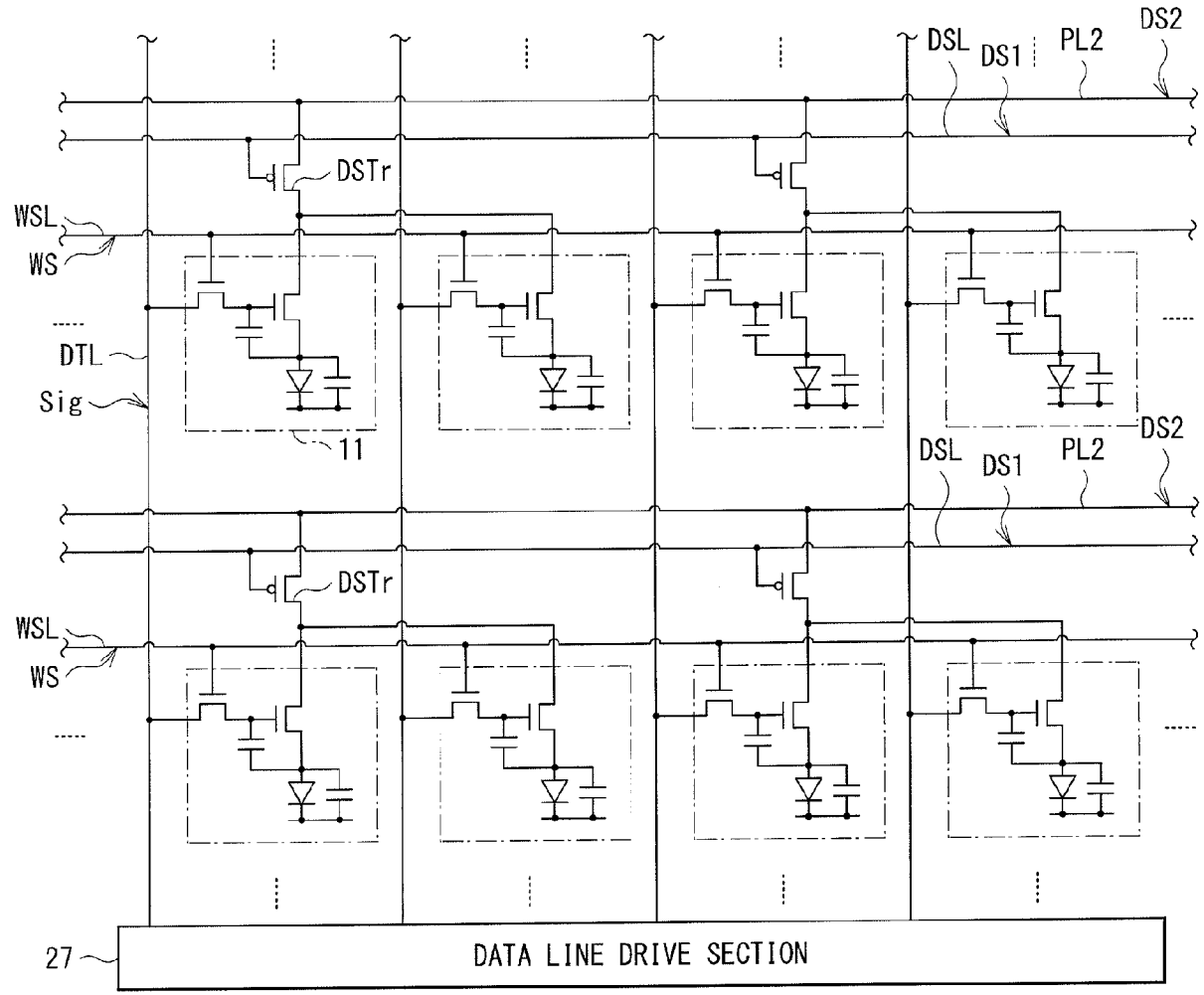
FIG. 20 is a circuit diagram illustrating an exemplary circuit configuration of a display section according to another Modification.

FIG. 20 illustrates an exemplary configuration of a display section 10C according to Modification 2. As illustrated in FIG. 20, the display section 10C includes power control lines DSL and power lines PL2 extending in a row direction. Each of the power control lines DSL is configured to transmit a power control signal DS1, and is connected at one end thereof to a power control section 25. Each of the power lines PL2 is configured to transmit a power signal DS2, and is connected at one end thereof to a power drive section 26. In this exemplary case, one power supply transistor DSTr is provided for two sub-pixels 11 adjacent in a horizontal (lateral) direction. In other words, although one power supply transistor DSTr is provided for the certain number of sub-pixels 11 corresponding to one line in the above-described embodiment, one power supply transistor DSTr is provided for two sub-pixels 11 in the display section 10C according to the Modification 2. The gate of the power supply transistor DSTr is connected to the power control line DSL, the source thereof is connected to the power line PL2, and the drain thereof is connected to the respective drains of the drive transistors DRTr of the two sub-pixels 11.

When the display section 10C having such a configuration is used, the correction processing section 40 obtains an average Avg of two pieces of luminance information I(1) and I(2) corresponding to the two sub-pixels 11 connected to the drain of the power supply transistor DSTr based on the two pieces of luminance information I(1) and I(2), and generates two pieces of luminance information J(1) and J(2) based on the two pieces of luminance information I(1) and I(2) and the average Avg. This makes it possible to reduce a possibility that emission luminance of one of the two sub-pixels 11 is varied by luminance information I of the other sub-pixel 11, thereby leading to improvement in image quality.

[Modification 3]

Figure 21:
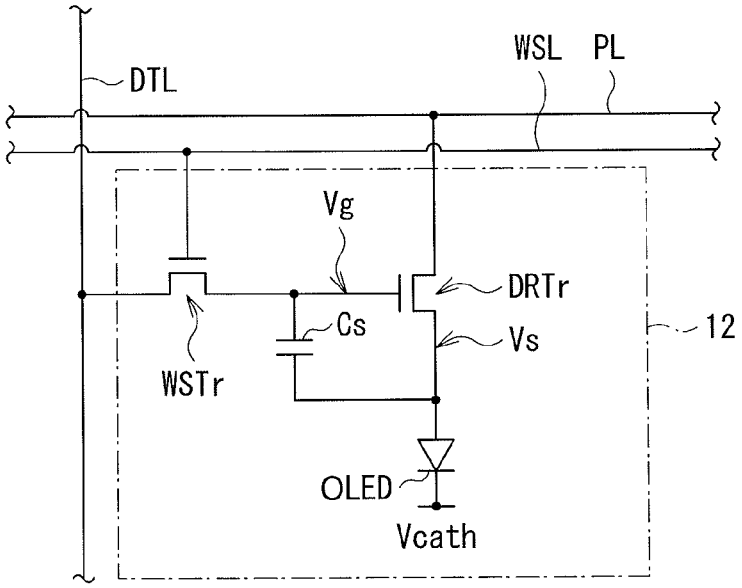
FIG. 21 is a circuit diagram illustrating an exemplary circuit configuration of a sub-pixel according to another Modification.

Although the sub-pixel 11 having a "2Tr2C" configuration is provided using two transistors (the write transistor WSTr and the drive transistor DRTr) and two capacitors Cs and Csub in the above-described embodiment, this is not limitative. As illustrated in FIG. 21, a sub-pixel 12 having a so-called "2Tr1C" configuration without the capacitor Csub may be provided. In this case, for example, the light emitting device OLED may preferably emit white light that passes through a color filter to generate four colors of red (R), green (G), blue (B), and white (W). This achieves a substantially constant capacitance value of the equivalent capacitance of the light emitting device OLED regardless of the sub-pixel 12. Alternatively, different light emitting devices OLED may be used, which have the same equivalent capacitance value, but emit different colors corresponding to individual sub-pixels 12 (each emitting light of one of red, green, blue, and white).

In the case where respective light emitting devices OLED of sub-pixels 12R, 12G, 12B, and 12W of red (R), green (G), blue (B), and white (W) have different equivalent capacitance values from one another, correction processing may be desirably performed for each of the colors of the sub-pixels 12. Modification 3 is now described in detail.

Figure 22:
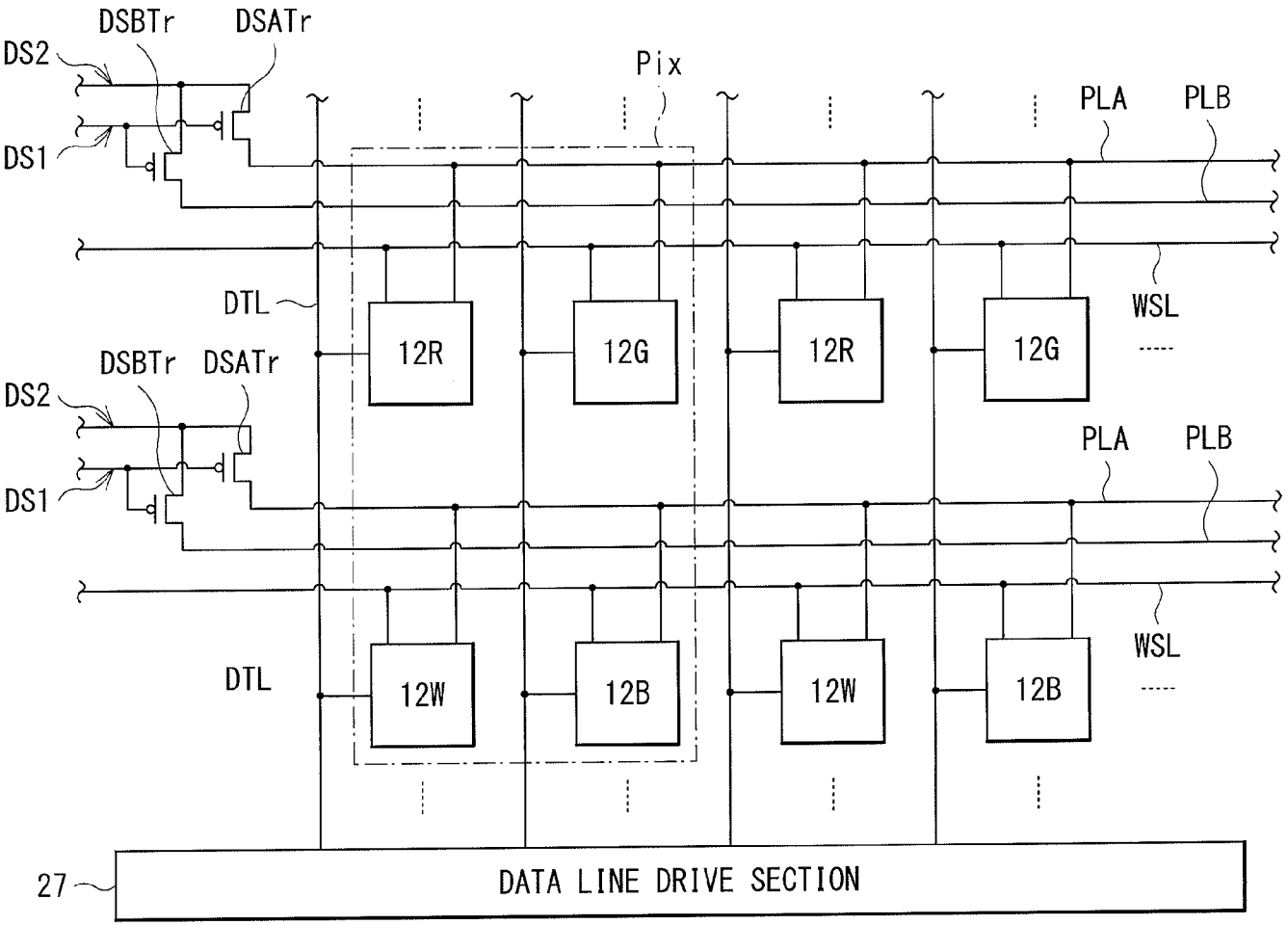
FIG. 22 is a circuit diagram illustrating an exemplary circuit configuration of a display section according to another Modification.

FIG. 22 illustrates an exemplary circuit configuration of a display section 10E according to the Modification 3. The display section 10E includes power lines PLA and PLB and power supply transistors DSATr and DSBTr. In each of lines to which sub-pixels 12R and 12G belong, the power line PLA is connected to M/2 sub-pixels 12R, while the power line PLB is connected to M/2 sub-pixels 12G. In each of lines to which sub-pixels 12W and 12B belong, the power line PLA is connected to M/2 sub-pixels 12W, while the power line PLB is connected to M/2 sub-pixels 12B. One end of the power line PLA is connected to the drain of the power supply transistor DSATr, while one end of the power line PLB is connected to the drain of the power supply transistor DSBTr. The source of the power supply transistor DSATr is connected to the source of the power supply transistor DSBTr and to a power drive section 26 (not shown), the gate thereof is connected to the gate of the power supply transistor DSBTr and to a power control section 25 (not shown), and the drain thereof is connected to the power line PLA. The source of the power supply transistor DSBTr is connected to the source of the power supply transistor DSATr and to the power drive section 26 (not shown), the gate thereof is connected to the gate of the power supply transistor DSATr and to the power control section 25 (not shown), and the drain thereof is connected to the power line PLB.

In the case where the display section 10E having such a configuration is used, the correction processing section 40 performs correction processing for each of colors of the sub-pixels 12. Specifically, the correction processing section 40 performs the correction processing on a line to which the sub-pixels 12R and 12G belong, the correction processing including: obtaining an average Avg of M/2 pieces of luminance information I corresponding to M/2 sub-pixels 12R connected to the drain of the power supply transistor DSATr based on the M/2 pieces of luminance information I; generating luminance information J based on the pieces of luminance information I and the average Avg; obtaining an average Avg of M/2 pieces of luminance information I corresponding to M/2 sub-pixels 12G connected to the drain of the power supply transistor DSBTr based on the M/2 pieces of luminance information I; and generating luminance information J based on the pieces of luminance information I and the average Avg. Similarly, the correction processing section 40 performs the correction processing on a line to which the sub-pixels 12W and 12B belong, the correction processing including: obtaining an average Avg of M/2 pieces of luminance information I corresponding to M/2 sub-pixels 12W connected to the drain of the power supply transistor DSATr based on the M/2 pieces of luminance information I; generating luminance information J based on the pieces of luminance information I and the average Avg; obtaining an average Avg of M/2 pieces of luminance information I corresponding to M/2 sub-pixels 12B connected to the drain of the power supply transistor DSBTr based on the M/2 pieces of luminance information I; and generating luminance information J based on the pieces of luminance information I and the average Avg. This makes it possible to reduce a possibility that emission luminance of a focused sub-pixel 12 in the M/2 sub-pixels 12 is varied by luminance information I of another sub-pixel 12, leading to improvement in image quality.

[Modification 4]

Although TFT is configured such that the gate electrode 110 is provided below the polysilicon layer 140 in the above-described embodiment, the TFT configuration is not limited thereto. Alternatively, for example, the gate electrode may be provided above the polysilicon layer. Modification 4 is now described in detail.

Figure 23:
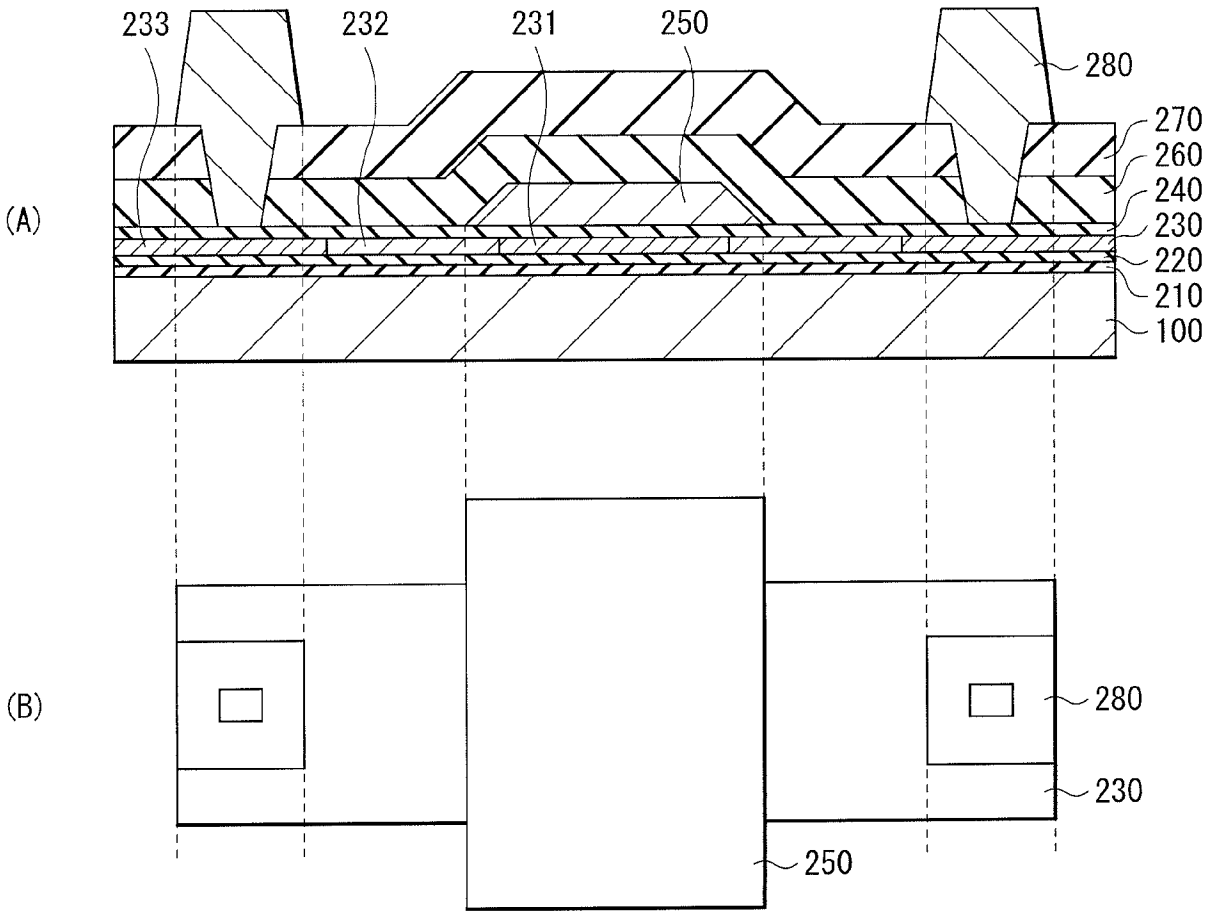
FIG. 23 is an explanatory diagram illustrating an exemplary configuration of a transistor according to another Modification.

FIG. 23 illustrates an exemplary configuration of TFT, where (A) illustrates a cross-sectional diagram, and (B) illustrates a relevant-part plan diagram. The TFT includes a gate electrode 250 and a polysilicon layer 230. The polysilicon layer 230 is provided on insulating layers 210 and 220 formed on a substrate 100. For example, the insulating layer 210 may be formed of silicon nitride (SiNx), and the insulating layer 220 may be formed of silicon oxide ($SiO_2$). The polysilicon layer 230 is configured of a channel region 231, LDD 232, and a contact region 233 as with the above-described embodiment. An insulating layer 240 is provided on the polysilicon layer 230. For example, the insulating layer 240 may be formed of silicon oxide ($SiO_2$). The gate electrode 250 is provided on the insulating layer 240. For example, the gate electrode 250 may be formed of molybdenum Mo. In this way, the gate electrode 250 in this exemplary case is provided above the polysilicon layer 230. In other words, the TFT has a so-called top gate structure. Insulating layers 260 and 270 are provided in this order on the gate electrode 250 and the insulating layer 240. For example, the insulating layer 260 may be formed of silicon oxide ($SiO_2$), and the insulating layer 270 may be formed of silicon nitride (SiNx). An interconnection 280 is provided on the insulating layer 270. An opening is provided through the insulating layers 240, 260, and 270 in a region corresponding to a contact region 233 of the polysilicon layer 230. The interconnection 280 is provided so as to be connected to the contact region 233 via the opening.

[Modification 5]

Figure 24:
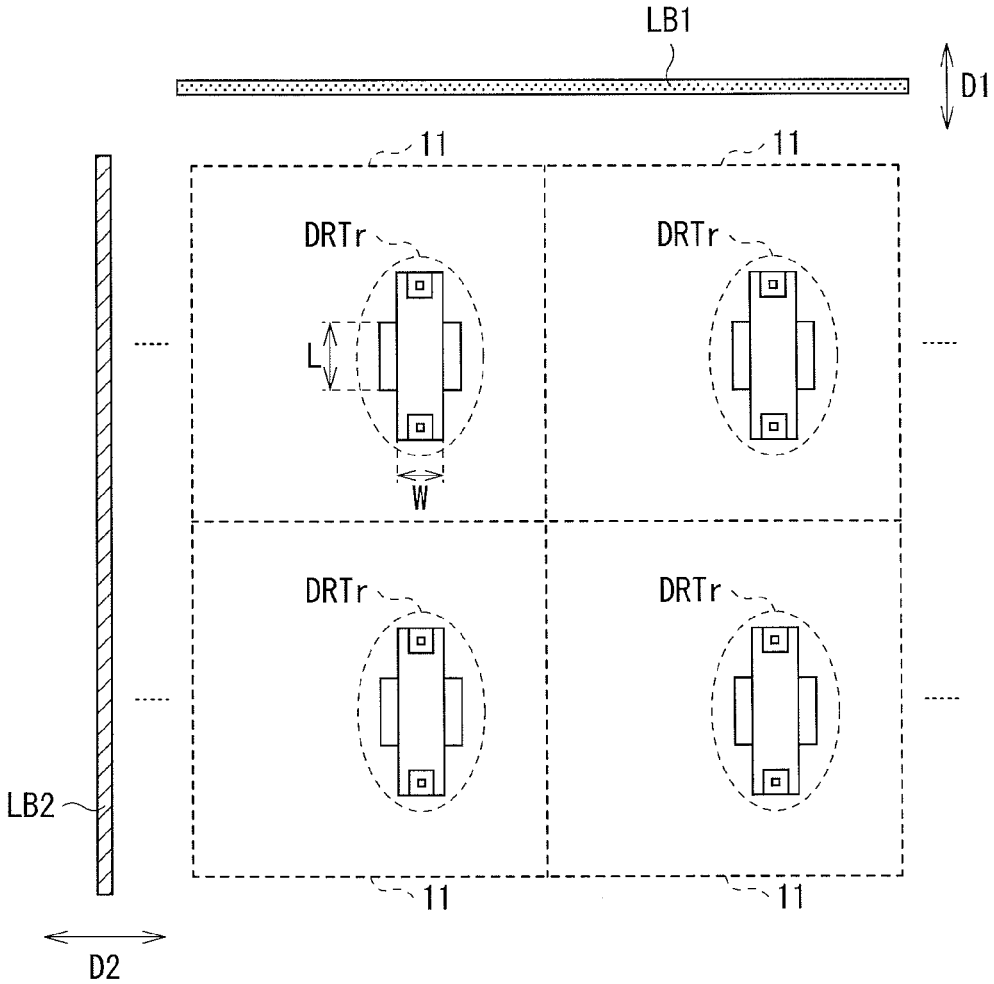
FIG. 24 is an explanatory diagram illustrating a layout of drive transistors according to another Modification.
Figure 25:
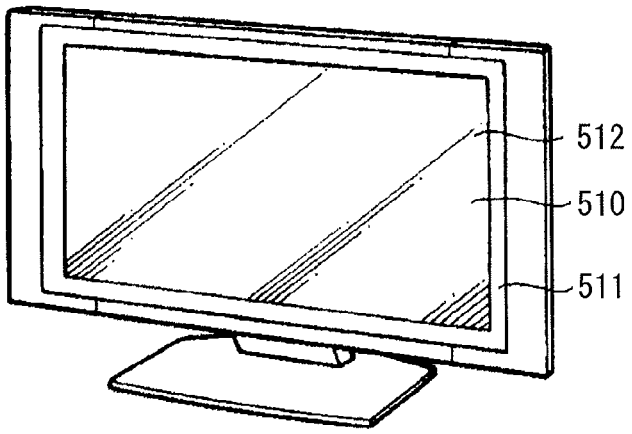
FIG. 25 is a perspective diagram illustrating an appearance configuration of a television unit to which the display according to any of the example embodiments and the Modifications is applied.

Although each drive transistor DRTr is disposed such that the channel length (L) direction thereof corresponds to the scan direction D2 in the above-described embodiment, this is not limitative. Alternatively, for example, as illustrated in FIG. 24, the drive transistor DRTr may be disposed such that the channel width (W) direction thereof corresponds to the scan direction D2.

2. APPLICATION EXAMPLES

Application examples of each of the displays described in the above-described embodiment and the Modifications are now described.

FIG. 23 illustrates appearance of a television unit to which any of the displays according to the above-described embodiment and the Modifications is applied. The television unit may have, for example, an image display screen section 510 including a front panel 511 and a filter glass 512. The image display screen section 510 is configured of any of the displays according to the above-described embodiment and the Modifications.

The display according to any of the above-described embodiment and the Modifications is applicable to an electronic apparatus in any field. In addition to the television unit, examples of the electronic apparatus may include a digital camera, a notebook personal computer, a mobile terminal unit such as a mobile phone, a portable video game player, and a video camera. In other words, the display according to any of the above-described embodiment and the Modifications is applicable to an electronic apparatus that displays images in any field.

Although the technology according to the present disclosure has been described with the embodiment, the Modifications, and the application examples to electronic apparatuses hereinbefore, the technology is not limited thereto, and various modifications or alterations may be made.

For example, although the pixel Pix is configured of four sub-pixels 11 of red (R), green (G), blue (B), and white (W) in the above-described embodiment and the Modifications, the pixel Pix is not limited thereto. Alternatively, for example, the pixel Pix may be configured of four sub-pixels 11 of red (R), green (G), blue (B), and yellow (Y), or may be configured of three-color sub-pixels 11 of red (R), green (G), and blue (B).

Moreover, for example, although the write transistor WSTr and the drive transistor DRTr are each configured of a negative-channel metal oxide semiconductor (NMOS) in the above-described embodiment and the Modifications, the transistors are not limited thereto. Alternatively, one or both of such transistors may be configured of a positive-channel metal oxide semiconductor (PMOS). Similarly, for example, although the power supply transistor DSTr is configured of PMOS in the above-described embodiment and the Modifications, the transistor is not limited thereto. Alternatively, the power supply transistor DSTr may be configured of NMOS.

It is to be noted that the technology according to the present disclosure may be configured as follows.

(1) A display, including:

a plurality of unit pixels;

a control transistor; and a correction processing section, wherein the plurality of unit pixels each includes a display device and a drive transistor that is configured to supply a drive current to the display device, the control transistor is disposed on a current path of the drive current to a unit pixel group formed of a predetermined number of unit pixels out of the plurality of unit pixels, and the correction processing section is configured to obtain a signal average of a plurality of pieces of luminance information out of a predetermined number of pieces of luminance information corresponding to the predetermined number of unit pixels, and correct the plurality of pieces of luminance information based on the signal average.

(2) The display according to (1), wherein the plurality of pieces of luminance information are each luminance information having a luminance level higher than a predetermined luminance level among the predetermined number of pieces of luminance information.

(3) The display according to (1) or (2), wherein the correction processing section performs correction by replacing luminance information I with luminance information J using the following expression, $$J=(1-\alpha)\times I+\alpha\times \mathrm{Avg}$$

where Avg represents the signal average, and $\alpha$ is a constant of 0 to 1 both inclusive.

(4) The display according to any one of (1) to (3), wherein the unit pixel group is configured of unit pixels corresponding to one pixel line.

(5) The display according to any one of (1) to (3), wherein the unit pixel group is configured of two or more unit pixels out of unit pixels corresponding to one pixel line.

(6) The display according to (5), wherein the two or more unit pixels display colors equal to each other.

(7) The display according to any one of (1) to (6), further including a drive section including a D/A conversion section that is configured to convert each of the pieces of luminance information corrected by the correction processing section into a pixel voltage through linear conversion, the pieces of luminance information each being a digital signal.

(8) The display according to any one of (1) to (6), further including:

a conversion section configured to perform nonlinear conversion on each of the pieces of luminance information corrected by the correction processing section, the pieces of luminance information each being a digital signal; and a drive section including a D/A conversion section that is configured to convert the luminance information subjected to the nonlinear conversion into a pixel voltage while performing gamma conversion on the luminance information, wherein the nonlinear conversion has conversion characteristics opposite to conversion characteristics of the gamma conversion.

(9) The display according to (7) or (8), wherein the unit pixel further includes a capacitor, and the drive transistor includes a gate connected to a first end of the capacitor, a source connected to a second end of the capacitor and to the display device, and a drain connected to the control transistor.

(10) The display according to (9), wherein in a first period, the drive section sets a gate voltage of each of the drive transistors in the unit pixel group to a first voltage, and sets a source voltage of each of the drive transistors to a second voltage, and in a second period following the first period, the drive section sets the gate voltage of each of the drive transistors in the unit pixel group to the first voltage, and turns on the control transistor to cause a current flow through each of the drive transistors in the unit pixel group to change the source voltage of each of the drive transistors.

(11) The display according to (10), wherein in a third period following the second period, the drive section turns off the control transistor, and applies the pixel voltage to the gate of the drive transistor of each of the unit pixels in the unit pixel group, the pixel voltage corresponding to the individual unit pixel.

(12) A display, including:

a plurality of unit pixels;

a control transistor; and a correction processing section, wherein the plurality of unit pixels each include a display device and a drive transistor that is configured to supply a drive current to the display device, the control transistor is disposed on a current path of the drive current to a unit pixel group formed of a predetermined number of unit pixels out of the plurality of unit pixels, and the correction processing section is configured to correct luminance information of a focused unit pixel in the unit pixel group to prevent luminance of the focused unit pixel from being varied by luminance information of a unit pixel other than the focused unit pixel in the unit pixel group.

(13) A display drive circuit, including:

a correction processing section; and a drive section, wherein the correction processing section is configured to obtain a signal average of a plurality of pieces of luminance information out of a predetermined number of pieces of luminance information corresponding to a predetermined number of unit pixels of a unit pixel group, and correct the plurality of pieces of luminance information based on the signal average, the unit pixel group being formed of the predetermined number of unit pixels out of a plurality of unit pixels each including a display device and a drive transistor that is configured to supply a drive current to the display device, a control transistor being disposed on a current path of the drive current to the unit pixel group, and the drive section is configured to drive the unit pixels based on the pieces of corrected luminance information.

(14) A display drive method, including:

obtaining a signal average of a plurality of pieces of luminance information out of a predetermined number of pieces of luminance information corresponding to a predetermined number of unit pixels of a unit pixel group, the unit pixel group being formed of the predetermined number of unit pixels out of a plurality of unit pixels each including a display device and a drive transistor that is configured to supply a drive current to the display device, a control transistor being disposed on a current path of the drive current to the unit pixel group;

correcting the plurality of pieces of luminance information based on the signal average; and driving the unit pixels based on the pieces of corrected luminance information.

(15) An electronic apparatus provided with a display and a control section configured to perform operation control on the display, the display including:

a plurality of unit pixels;

a control transistor; and a correction processing section, wherein the plurality of unit pixels each includes a display device and a drive transistor that is configured to supply a drive current to the display device, the control transistor is disposed on a current path of the drive current to a unit pixel group formed of a predetermined number of unit pixels out of the plurality of unit pixels, and the correction processing section is configured to obtain a signal average of a plurality of pieces of luminance information out of a predetermined number of pieces of luminance information corresponding to the predetermined number of unit pixels, and correct the plurality of pieces of luminance information based on the signal average.

(16) A display, comprising:

a plurality of pixel circuits respectively including a display element and a drive transistor that is configured to provide a drive current to the display element according to a luminance information value;

a control transistor; and a correction processing section, wherein the control transistor is disposed on a current path that provides the drive current to a unit pixel group that includes two or more of the pixel circuits, and the correction processing section is configured to obtain a correction factor that is a function of the luminance information values respectively corresponding to each of the pixel circuits in the unit pixel group, and to perform a correction of the luminance information value for at least one of the pixel circuits in the unit pixel group based on the correction factor.

(17) The display according to (16), wherein the function includes an average of the luminance information values of the pixel circuits in the unit pixel group.

(18) The display according to (16) or (17), wherein the correction processing section performs the correction only for those of the pixel circuits in the unit pixel group having the luminance information value higher than a predetermined luminance level.

(19) The display according to any of (16) through (18), wherein the correction processing section performs the correction by replacing luminance information I with luminance information J using the following expression, $$J=(1-\alpha)I+\alpha\times\mathrm{Avg}$$

where Avg represents the average, and $\alpha$ is a constant of 0 to 1 both inclusive.

(20) The display according to any of (16) through (19), wherein the pixel circuits are arranged in a matrix having rows and columns, and the unit pixel group is a row of the pixel circuits.

(21) The display according to any of (16) through (20), wherein the pixel circuits are arranged in a matrix having rows and columns, and the unit pixel group is a subset of a row of the pixel circuits.

(22) The display according to any of (16) through (21), wherein the pixel circuits in the subset correspond to the same color.

(23) The display according to any of (16) through (22), further comprising a drive section including a D/A conversion section that is configured to convert each of the luminance information values corrected by the correction processing section into a pixel voltage through linear conversion, the luminance information values each being a digital signal.

(24) The display according to any of (16) through (23), further comprising:

a conversion section configured to perform nonlinear conversion on each of the luminance information values corrected by the correction processing section, the luminance information values each being a digital signal; and a drive section including a D/A conversion section that is configured to convert the luminance information values subjected to the nonlinear conversion into a pixel voltage while performing gamma conversion on the luminance information values, wherein the nonlinear conversion has conversion characteristics opposite to conversion characteristics of the gamma conversion.

(25) The display according to any of (16) through (24), wherein the pixel circuits respectively include a capacitor, and the drive transistor includes a gate connected to a first end of the capacitor, a source connected to a second end of the capacitor and to the display element, and a drain connected to the control transistor.

(26) The display according to any of (16) through (25), wherein in a first period, the drive section sets a gate voltage of each of the drive transistors in the unit pixel group to a first voltage, and sets a source voltage of each of the drive transistors to a second voltage, and in a second period following the first period, the drive section sets the gate voltage of each of the drive transistors in the unit pixel group to the first voltage, and turns on the control transistor to cause a current flow through each of the drive transistors in the unit pixel group to change the source voltage of each of the drive transistors.

(27) The display according to any of (16) through (26), wherein in a third period following the second period, the drive section turns off the control transistor, and respectively applies a pixel voltage to the gate of the drive transistor of each of the pixel circuits in the unit pixel group.

(28) A display, comprising:

a plurality of pixel circuits respectively including a display element and a drive transistor that is configured to provide a drive current to the display element according to a luminance information value;

a control transistor; and a correction processing section, wherein the control transistor is disposed on a current path that provides the drive current to a unit pixel group that includes two or more of the pixel circuits, and the correction processing section is configured to correct the luminance information value of a focused pixel circuit in the unit pixel group to prevent luminance of the focused pixel circuit from being varied by the luminance information of another pixel circuit in the unit pixel group.

(29) A display drive circuit for driving pixel circuits respectively including a display element and a drive transistor that is configured to provide a drive current to the display element according to a luminance information value, the display drive circuit comprising:

a correction processing section; and a drive section, wherein the correction processing section is configured to obtain a correction factor that is a function of the luminance information values respectively corresponding to each of the pixel circuits in a unit pixel group that includes two or more of the pixel circuits, wherein a control transistor is disposed on a current path that provides the drive current to the unit pixel group, and to perform a correction of the luminance information value for at least one of the pixel circuits in the unit pixel group based on the correction factor, the drive section is configured to drive the pixel circuits in the unit pixel group based on the corrected luminance information.

(30) A method for driving pixel circuits respectively including a display element and a drive transistor that is configured to provide a drive current to the display element according to a luminance information value, the method comprising:

obtaining a correction factor that is a function of the luminance information values respectively corresponding to each of the pixel circuits in a unit pixel group that includes two or more of the pixel circuits, wherein a control transistor is disposed on a current path that provides the drive current to the unit pixel group, and performing a correction of the luminance information value for at least one of the pixel circuits in the unit pixel group based on the correction factor; and driving the pixel circuits in the unit pixel group based on the corrected luminance information.

(31) An electronic apparatus comprising a display according to (16), and a control section configured to perform operation control on the display.

(32) The display drive circuit according to (29), wherein the function includes an average of the luminance information values of the pixel circuits in the unit pixel group.

(33) The display drive circuit according to (29) or (32), wherein the correction processing section performs the correction only for those of the pixel circuits in the unit pixel group having the luminance information value higher than a predetermined luminance level.

(34) The electronic apparatus according to (31), wherein the function includes an average of the luminance information values of the pixel circuits in the unit pixel group.

(35) The electronic apparatus according to (31) or (34), wherein the correction processing section performs the correction only for those of the pixel circuits in the unit pixel group having the luminance information value higher than a predetermined luminance level.

It should be understood by those skilled in the art that various modifications, combinations, sub-combinations and alterations may occur depending on design requirements and other factors insofar as they are within the scope of the appended claims or the equivalents thereof.

What is claimed is:

1. A display comprising:

a plurality of pixel circuits, each pixel circuit of the plurality of pixel circuits includes a display element and a drive transistor that is configured to provide a drive current to the display element according to a luminance information value;

a control transistor disposed on a current path between a single power supply line and a unit pixel group that includes two or more of the plurality of pixel circuits, the control transistor configured to receive a control signal, electrically connect the unit pixel group to the single power supply line based on the control signal, and electrically disconnect the unit pixel group from the single power supply line based on the control signal; and a display drive circuit including a correction processing circuitry, a conversion circuitry, and a drive circuitry, the correction processing circuitry is configured to obtain a correction factor that is a function of a plurality of luminance information values that correspond to each of the two or more of the plurality of pixel circuits that are in the unit pixel group, and perform a correction of a first luminance information value for at least one of the plurality of pixel circuits in the unit pixel group based on the correction factor, the conversion circuitry is configured to perform a nonlinear conversion on the first luminance information value to generate a second luminance information value, the second luminance information value being a digital signal, and the drive circuitry includes a digital-to-analog (D/A) conversion circuitry, the drive circuitry is configured to convert the second luminance information value subjected to the nonlinear conversion into a pixel voltage while performing gamma conversion on the second luminance information value, wherein the nonlinear conversion has conversion characteristics opposite to conversion characteristics of the gamma conversion.

2. The display according to claim 1, wherein the function of the plurality of luminance information values includes an average of the plurality of luminance information values of the two or more of the plurality of pixel circuits in the unit pixel group.

3. The display according to claim 1, wherein the correction processing circuitry performs the correction only for those of the two or more of the plurality of pixel circuits in the unit pixel group having the luminance information value higher than a predetermined luminance level.

4. The display according to claim 2, wherein the correction processing circuitry performs the correction by replacing luminance information I with luminance information J using the following expression, $$J=(1-\alpha)\times I+\alpha\times \mathrm{Avg}$$

where Avg represents the average, and $\alpha$ is a constant of 0 to 1 both inclusive.

5. The display according to claim 1, wherein the plurality of pixel circuits is arranged in a matrix having rows and columns, and wherein the unit pixel group is a row of the plurality of pixel circuits.

6. The display according to claim 1, wherein the plurality of pixel circuits is arranged in a matrix having rows and columns, and wherein the unit pixel group is a subset of a row of the plurality of pixel circuits.

7. The display according to claim 6, wherein the two or more of the plurality of pixel circuits in the subset correspond to a same color.

8. The display according to claim 1, wherein the drive circuitry is further configured to convert the first luminance information value into a second pixel voltage through linear conversion, the first luminance information value being a second digital signal.

9. The display according to claim 8, wherein the each pixel circuit of the plurality of pixel circuits includes a capacitor, and wherein the drive transistor of the each pixel circuit of the plurality of pixel circuits includes a gate connected to a first end of the capacitor, a source connected to a second end of the capacitor and to the display element, and a drain connected to the control transistor.

10. The display according to claim 9, wherein in a first period, the drive circuitry sets a gate voltage of the drive transistor of the two or more of the plurality of pixel circuits in the unit pixel group to a first voltage, and sets a source voltage of the drive transistor of the two or more of the plurality of pixel circuits to a second voltage, and in a second period following the first period, the drive circuitry sets the gate voltage of the drive transistor of the two or more of the plurality of pixel circuits in the unit pixel group to the first voltage, and turns on the control transistor to cause a current flow through the drive transistor of the two or more of the plurality of pixel circuits in the unit pixel group to change the source voltage of the drive transistor of the two or more of the plurality of pixel circuits.

11. The display according to claim 10, wherein in a third period following the second period, the drive circuitry turns off the control transistor, and respectively applies a pixel voltage to the gate of the drive transistor of the each pixel circuit of the two or more of the plurality of pixel circuits in the unit pixel group.

12. A display comprising:

a plurality of pixel circuits, each pixel circuit of the plurality of pixel circuits includes a display element and a drive transistor that is configured to provide a drive current to the display element according to a luminance information value;

a control transistor disposed on a current path between a single power supply line and a unit pixel group that includes two or more of the plurality of pixel circuits, the control transistor configured to receive a control signal, electrically connect the unit pixel group to the single power supply line based on the control signal, and electrically disconnect the unit pixel group from the single power supply line based on the control signal; and a display drive circuitry including a correction processing circuitry, a conversion circuitry, and a drive circuitry, the correction processing circuitry is configured to correct the luminance information value of a focused pixel circuit in the unit pixel group to generate a first luminance information value, the first luminance information value prevents luminance of the focused pixel circuit from being varied by second luminance information of another pixel circuit in the unit pixel group, the conversion circuitry is configured to perform a nonlinear conversion on the first luminance information value to generate a second luminance information value, the second luminance information value being a digital signal, and the drive circuitry includes a digital-to-analog (D/A) conversion circuitry, the drive circuitry is configured to convert the second luminance information value subjected to the nonlinear conversion into a pixel voltage while performing gamma conversion on the second luminance information value, wherein the nonlinear conversion has conversion characteristics opposite to conversion characteristics of the gamma conversion.

13. A display drive circuit for driving a plurality of pixel circuits, each pixel circuit of the plurality of pixel circuits includes a display element and a drive transistor that is configured to provide a drive current to the display element according to a luminance information value, the display drive circuit comprising:

a correction processing circuitry configured to obtain a correction factor that is a function of a plurality of luminance information values that correspond to the each pixel circuit of the plurality of pixel circuits that are in a unit pixel group that includes two or more of the plurality of pixel circuits, and perform a correction of a first luminance information value for at least one of the plurality of pixel circuits in the unit pixel group based on the correction factor;

a conversion circuitry configured to perform a nonlinear conversion on the first luminance information value to generate a second luminance information value, the second luminance information value being a digital signal; and a drive circuitry including a digital-to-analog (D/A) conversion circuitry, the drive circuitry configured to transmit a control signal to a control transistor disposed on a current path between a single power supply line and the unit pixel group, the control signal configured to control the control transistor to electrically connect the unit pixel group to the single power supply line, electrically disconnect the unit pixel group from the single power supply line, convert the second luminance information value subjected to the nonlinear conversion into a pixel voltage while performing gamma conversion on the second luminance information value, wherein the nonlinear conversion has conversion characteristics opposite to conversion characteristics of the gamma conversion, and drive the at least one of the plurality of pixel circuits in the unit pixel group based on the pixel voltage.

14. The display drive circuit according to claim 13, wherein the function of the plurality of luminance information values includes an average of the plurality of luminance information values of the two or more of the plurality of pixel circuits in the unit pixel group.

15. The display drive circuit according to claim 13, wherein the correction processing circuitry performs the correction only for those of the two or more of the plurality of pixel circuits in the unit pixel group having the luminance information value higher than a predetermined luminance level.

16. A method for driving a plurality of pixel circuits, each pixel circuit of the plurality of pixel circuits includes a display element and a drive transistor that is configured to provide a drive current to the display element according to a luminance information value, the method comprising:

obtaining a correction factor that is a function of a plurality of luminance information values that correspond to the each pixel circuit of the plurality of pixel circuits that are in a unit pixel group that includes two or more of the plurality of pixel circuits;

performing a correction of a first luminance information value for at least one of the plurality of pixel circuits in the unit pixel group based on the correction factor;

transmitting a control signal to a control transistor disposed on a current path between a single power supply line and the unit pixel group to control the control transistor to electrically connect the unit pixel group to the single power supply line;

performing a nonlinear conversion on the first luminance information value to generate a second luminance information value, the second luminance information value being a digital signal;

converting the second luminance information value subjected to the nonlinear conversion into a pixel voltage while performing gamma conversion on the second luminance information value, wherein the nonlinear conversion has conversion characteristics opposite to conversion characteristics of the gamma conversion; and driving the at least one of the plurality of pixel circuits in the unit pixel group based on the pixel voltage.

17. An electronic apparatus comprising:

a display including a plurality of pixel circuits, each pixel circuit of the plurality of pixel circuits includes a display element and a drive transistor that is configured to provide a drive current to the display element according to a luminance information value;

a control transistor disposed on a current path between a single power supply line and a unit pixel group that includes two or more of the plurality of pixel circuits, the control transistor configured to receive a control signal, electrically connect the unit pixel group to the single power supply line based on the control signal, and electrically disconnect the unit pixel group from the single power supply line based on the control signal; and a display drive circuit including a correction processing circuitry, a conversion circuitry, and a drive circuitry, the correction processing circuitry is configured to obtain a correction factor that is a function of a plurality of luminance information values that correspond to each of the two or more of the plurality of pixel circuits that are in the unit pixel group, and perform a correction of a first luminance information value for at least one of the plurality of pixel circuits in the unit pixel group based on the correction factor, the conversion circuitry is configured to perform a nonlinear conversion on the first luminance information value to generate a second luminance information value, the second luminance information value being a digital signal, and the drive circuitry includes a digital-to-analog (D/A) conversion circuitry, the drive circuitry is configured to convert the second luminance information value subjected to the nonlinear conversion into a pixel voltage while performing gamma conversion on the second luminance information value, wherein the nonlinear conversion has conversion characteristics opposite to conversion characteristics of the gamma conversion; and a control circuitry is configured to perform operation control on the display.

18. The electronic apparatus according to claim 17, wherein the function of the plurality of luminance information values includes an average of the plurality of luminance information values of the two or more of the plurality of pixel circuits in the unit pixel group.

19. The electronic apparatus according to claim 17, wherein the correction processing circuitry performs the correction only for those of the two or more of the plurality of pixel circuits in the unit pixel group having the luminance information value higher than a predetermined luminance level.

* * * * *